US007861894B2

(12) United States Patent
Walters et al.

(10) Patent No.: US 7,861,894 B2
(45) Date of Patent: Jan. 4, 2011

(54) LOCKABLE DISPENSER

(75) Inventors: Peter J. Walters, Barrington, IL (US); Jason A. Ksiazk, Arlington Heights, IL (US)

(73) Assignee: Seaquistperfect Dispensing L.L.C., Cary, IL (US)

( * ) Notice: Subject to any disclaimer, the term of this patent is extended or adjusted under 35 U.S.C. 154(b) by 549 days.

(21) Appl. No.: 11/894,844

(22) Filed: Aug. 22, 2007

(65) Prior Publication Data

US 2009/0050650 A1 Feb. 26, 2009

(51) Int. Cl.
*B67B 5/00* (2006.01)

(52) U.S. Cl. ..... 222/153.11; 222/402.11; 222/402.12; 222/402.13

(58) Field of Classification Search ..... 222/402.11, 222/153.11, 402.12, 402.13, 402.1
See application file for complete search history.

(56) References Cited

U.S. PATENT DOCUMENTS

| | | | | |
|---|---|---|---|---|
| 2,877,936 | A * | 3/1959 | Daniel | 222/182 |
| 2,887,273 | A * | 5/1959 | Anderson et al. | 239/337 |
| 3,306,252 | A | 2/1967 | Knight et al. | |
| 3,318,492 | A * | 5/1967 | Haas | 222/402.11 |
| 3,415,426 | A * | 12/1968 | Kleveland | 222/402.11 |
| 3,426,948 | A | 2/1969 | Stirling | |
| 3,503,543 | A * | 3/1970 | Mason et al. | 222/402.11 |
| 3,601,290 | A | 8/1971 | Nigro | |
| 3,648,905 | A * | 3/1972 | Kauder | 222/402.21 |
| 6,523,722 | B1 | 2/2003 | Clark et al. | |
| 7,017,785 | B2 * | 3/2006 | Lasserre et al. | 222/402.13 |
| 7,246,722 | B2 | 7/2007 | Walters et al. | |
| 7,487,891 | B2 * | 2/2009 | Yerby et al. | 222/153.13 |
| 7,611,032 | B2 * | 11/2009 | Brunerie et al. | 222/153.11 |
| 2003/0071085 | A1 * | 4/2003 | Lasserre et al. | 222/521 |
| 2005/0017026 | A1 | 1/2005 | Yerby et al. | |
| 2005/0017027 | A1 | 1/2005 | Yerby et al. | |
| 2005/0184093 | A1 * | 8/2005 | Brunerie et al. | 222/153.11 |
| 2007/0039979 | A1 * | 2/2007 | Strand et al. | 222/402.11 |
| 2008/0041889 | A1 * | 2/2008 | Geier | 222/402.11 |
| 2008/0164285 | A1 * | 7/2008 | Hygema | 222/153.11 |

OTHER PUBLICATIONS

International Preliminary Report On Patentanbility for PCT/US2008/007796 issued Feb. 24, 2010.

* cited by examiner

*Primary Examiner*—Kevin P Shaver
*Assistant Examiner*—Donnell Long
(74) *Attorney, Agent, or Firm*—Wood, Phillips, Katz, Clark & Mortimer

(57) ABSTRACT

A dispenser is provided for use with an associated container having pressurized contents. The dispenser includes a base configured for fitment on the associated container, and an actuator snap-fit to the base for limited, relative rotation with respect thereto. The base of the dispenser includes a nozzle joined in fluid communication with a valve stem of an associated dispensing valve fitted to the container, such that deflection of the nozzle permits dispensing of the pressurized contents of the container therethrough. The actuator cooperates with the nozzle of the base to permit selective movement of the nozzle for convenient dispensing of the container contents.

20 Claims, 43 Drawing Sheets

LOCKABLE DISPENSER

TECHNICAL FIELD

The present invention relates generally to a hand-held dispensing package for fluent material. The invention more particularly relates to a dispenser that can be adjusted to selectively permit or prevent actuation of the dispenser and can be configured to be easily manipulated in a generally inverted orientation, such as for dispensing and applying hair care products.

BACKGROUND OF THE INVENTION AND TECHNICAL PROBLEMS POSED BY THE PRIOR ART

Finger-operable dispensers are typically adapted to be incorporated in dispensing systems mounted on hand-held containers that are commonly used for fluent products. Some dispensers are designed for use with a valve assembly and have a suitable discharge structure to produce a foam, mousse, or atomized spray. A dispensing system comprising such a valve assembly and cooperating dispenser is typically used for dispensing cosmetic products or other personal care products such as shaving cream or shaving foam, hair mousse, sun care products, etc., as well as other institutional, industrial, and household products.

Dispensing systems comprising a valve assembly and cooperating dispenser are typically mounted at the top of the container, such as a metal can containing the pressurized product. The dispenser typically includes an external actuator that is connected to the valve assembly and that provides a dispensing passage from which the product can be dispensed to a target area.

For some of these types of fluent products, the dispenser may be provided with a mechanism to render the actuator inoperable when the actuator is locked in a particular position which must be released by the user. This insures that the product is not dispensed accidentally during shipping or storage when the actuator might be subjected to inadvertent impact. Some dispensers can include a hood, overcap, or other cover that prevents the actuator from being actuated unintentionally during shipping or storage until the hood is subsequently removed from the package by the user.

SUMMARY OF THE INVENTION

The inventors of the present invention have developed an improved dispenser for dispensing a fluent substance product. The inventors have discovered that their innovative design provides advantages not heretofore contemplated in the packaging industry or suggested by the prior art. The dispenser includes a base, and an actuator which are joined together, preferably by a rotatable, snap-fit configuration. The actuator can be rotatably moved from a first locked position, to a second position in which the actuator can be depressed for dispensing product. The dispenser can be readily configured to facilitate use in an inverted orientation.

The invention can be embodied in a relatively robust design that minimizes the likelihood of dislodgement of the actuator from the package during an impact, such as when the package is dropped or bumped. The invention can be readily employed in dispensing packages incorporating various aesthetically pleasing designs. The invention readily accommodates designs for use with standard cans or other containers. The invention can be made with components that are molded or otherwise economically manufactured with high production quality to provide consistent operation unit-to-unit with high reliability.

The inventors of the present invention have discovered that their innovative dispenser is especially suitable for incorporation in a dispensing system with a valve. According to one aspect of one preferred form of the invention, a dispenser is provided to operate an aerosol valve for dispensing a fluent substance product from a pressurized container. The dispenser is especially suitable for use with a valve that (1) is installed at one end of a container, and (2) has an outwardly projecting, movable, product-dispensing stem that is normally biased from an actuated, open dispensing position to an unactuated, closed position. The valve may be of the toggle or tilt style wherein the stem is tilted to open the valve, or the valve may be of the vertical style wherein the stem is pushed straight inwardly to open the valve.

The dispenser of the invention comprises an actuator and a base. The actuator is adapted to be operatively associated with the valve stem for establishing fluid communication between the valve stem and the exterior of the actuator for dispensing the fluent substance product to a target area. The actuator has a force-bearing actuation region that can be conveniently subjected to an actuation force by consumer manipulation which moves the actuator, in turn moving the valve stem to the open dispensing position. The actuator also has a locking element.

In accordance with the present invention, the base of the dispenser of the present invention is configured for mounting on an associated container around the valve thereon, with the actuator of the dispenser rotatably mounted on the base, such that the actuator is adapted to be operatively associated with the stem of the valve for establishing fluid communication between the stem and the exterior of the actuator for dispensing product to a target area, such as user's hair, hands, etc.

The actuator of the dispenser is rotatably moveable on the base between: (a) a first rotated position, which prevents downward movement of the actuator relative to the base; and (b) a second rotated position, which permits generally downward movement of the actuator relative to the base for moving the stem from the closed position to the open position.

The actuator can be easily rotated between locked and unlocked conditions, such as, for example, through a conveniently small angle of rotation that is less than 90 degrees, and most preferably through an angle of rotation of about 45 degrees.

In accordance with the illustrated embodiments, one of the actuator and the base defines an abutment surface, and the other one of the actuator in the base defines a locking element, such that in the first rotated position of the actuator, the locking element engages the abutment surface, and such that in the second rotated position of the actuator, the locking element does not engage the abutment surface, to thereby permit generally downward movement of the actuator relative to the base to move the valve stem to its opening position.

Characterizing features of the dispenser particularly facilitate its convenient use by consumers for dispensing foamed products, such as hair mousse or the like. In particular, the actuator includes a proximal portion mounted on the base of the dispenser, and a distal portion defining a discharge opening. The base, in turn, comprises: i) an annular mounting ring on which the actuator is rotatably mounted, ii) a nozzle having an inlet in fluid communication with the valve stem, and a product-discharge orifice for dispensing product in a generally vertical direction through the opening in the actuator, and (iii) a flexible connector element for flexibly connecting the nozzle to the mounting ring, so that the generally downward movement of the actuator relative to the base deflects the nozzle relative to the mounting ring for moving the stem of the valve from its closed position to its dispensing position, so that product flows through the nozzle.

In the preferred embodiment, the actuator of the dispenser is of a generally elongated configuration, as is the nozzle of the base, such that the actuator can be configured to present a convenient finger pad or like actuation region for convenient manipulation by consumers. In one current embodiment, it is contemplated that the dispenser be used in association with a valve assembly and container to form a package which can be easily gripped and manipulated by consumers in an inverted orientation, thus facilitating convenient application of hair care products and the like.

The lockable nature of the present dispenser facilitates convenient and efficient storage and assembly of a package incorporating the present dispenser. To provide locking of the actuator of the dispenser, one of the dispenser base and dispenser actuator defines at least one locking element, and the other one of the base and actuator defines at least one stop surface, so that engagement between the locking element and the stop surface limits rotational movement of the actuator relative to the mounting ring of the base. In the preferred form, a pair of the locking elements are provided on the actuator, which elements also prevent downward movement of the actuator in its first, locked position.

Convenient use of the present dispenser is further facilitated by providing an arrangement whereby the position of the actuator, relative to the base, can be readily ascertained by a user. In particular, one of the base and the actuator defines a flexible, position-indicating projection, while the other one of the base and actuator defines a deflector engageable with the projection attendant to rotation of the actuator relative to the base. By this arrangement, at least one of an audible indication and a tactile indication of the rotated position of the actuator relative to the base as provided. In a preferred embodiment, a pair of the deflectors are provided, thereby providing a "double-click" each time the actuator is moved between its closed and dispensing positions relative to the base of the dispenser.

In accordance with the present invention, generally downward movement of the actuator of the dispenser relative to the base can be either pivotal, or generally non-pivotal, and acts to move the nozzle of the base in unison with the actuator, with the discharge orifice of the nozzle remaining in alignment and moving with the discharge opening defined by the distal portion of the actuator. In order to provide generally downwardly, pivotal movement of the actuator relative to the base, the base defines a support surface engageable by the proximal portion of the actuator, so that the actuator is generally downwardly, pivotably moveable relative to the base in the second, rotated position of the actuator.

In an alternative embodiment, the base of the dispenser defines a clearance region adjacent the mounting ring of the base into which the proximal portion of the actuator is moveable in the second, rotated position thereof, so that the actuator is generally downwardly, non-pivotally movable relative to the base in the second, rotated position of the actuator.

Efficient assembly of the present dispenser is achieved by respectively providing the actuator and mounting ring of the base with inter-engaging elements effecting a snap-fit of the actuator on to the mounting ring.

In the preferred form, the present dispenser is configured such that in the first rotated position of the actuator on the base, the discharge opening of the actuator is substantially closed by a shield element (e.g., member or door), provided on the nozzle of the base, positioned generally inwardly of the discharge opening of the actuator. In one illustrated embodiment, the shield element is generally planar, and extends generally laterally from the discharge orifice of the nozzle. In other embodiments, the shield element is of a generally tubular or hollow configuration, and extends the length of the nozzle. This arrangement facilitates manufacture of the shield element by injection molding techniques.

As noted, in the most preferred form of the invention, the dispenser also optionally provides a tactile sensation and/or audible indication when the actuator is rotated into, or away from, the locked position. In the most preferred form, two clicks or similar sounds are audible when the actuator is rotated into, or away from, the locked position. In the most preferred form, the dispenser also optionally provides a tactile sensation of increased resistance when the user rotates the actuator into, or away from, the locked position.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 19 is an isometric view similar to FIG. 1, but FIG. 19 shows the dispenser in the unactuated, but locked condition (whereas FIG. 1 shows the dispenser actuator in the unactuated, but unlocked, condition prior to use);

FIG. 21 shows the dispenser in the unactuated, but locked, condition wherein the actuator has been rotated (relative to FIG. 1) about 45 degrees relative to the base which remains fixed on the container (not shown in FIG. 21);

FIG. 25 is an isometric view similar to FIG. 1, but FIG. 25 shows the package with the dispenser in the unlocked and actuated position (whereas FIG. 1 shows the package with the dispenser in the unlocked, but unactuated, condition prior to use), and FIG. 25 illustrates an actuation force being applied to the upper end of the actuator of the dispenser;

FIG. 42 is a view similar to FIG. 37, but FIG. 42 shows the package with the dispenser in the unlocked and actuated position (whereas FIG. 37 shows the package with the dispenser in the unlocked, but unactuated, condition prior to use), and FIG. 42 illustrates an actuation force being applied to a lower portion of the actuator;

FIG. 49 is a view similar to FIG. 44, but FIG. 49 shows the package with the dispenser in the unlocked and actuated position (whereas FIG. 44 shows the package with the dispenser in the unlocked, but unactuated, condition prior to use), and FIG. 49 illustrates an actuation force being applied to the lower part of the actuator;

FIG. 56 is a view similar to FIG. 51, but FIG. 56 shows the package with the dispenser in the unlocked and actuated position (whereas FIG. 51 shows the package with the dispenser in the unlocked, but unactuated, condition prior to use), and FIG. 56 illustrates an actuation force being applied to the upper end of the actuator.

DESCRIPTION OF THE PREFERRED EMBODIMENTS

Figure 1:
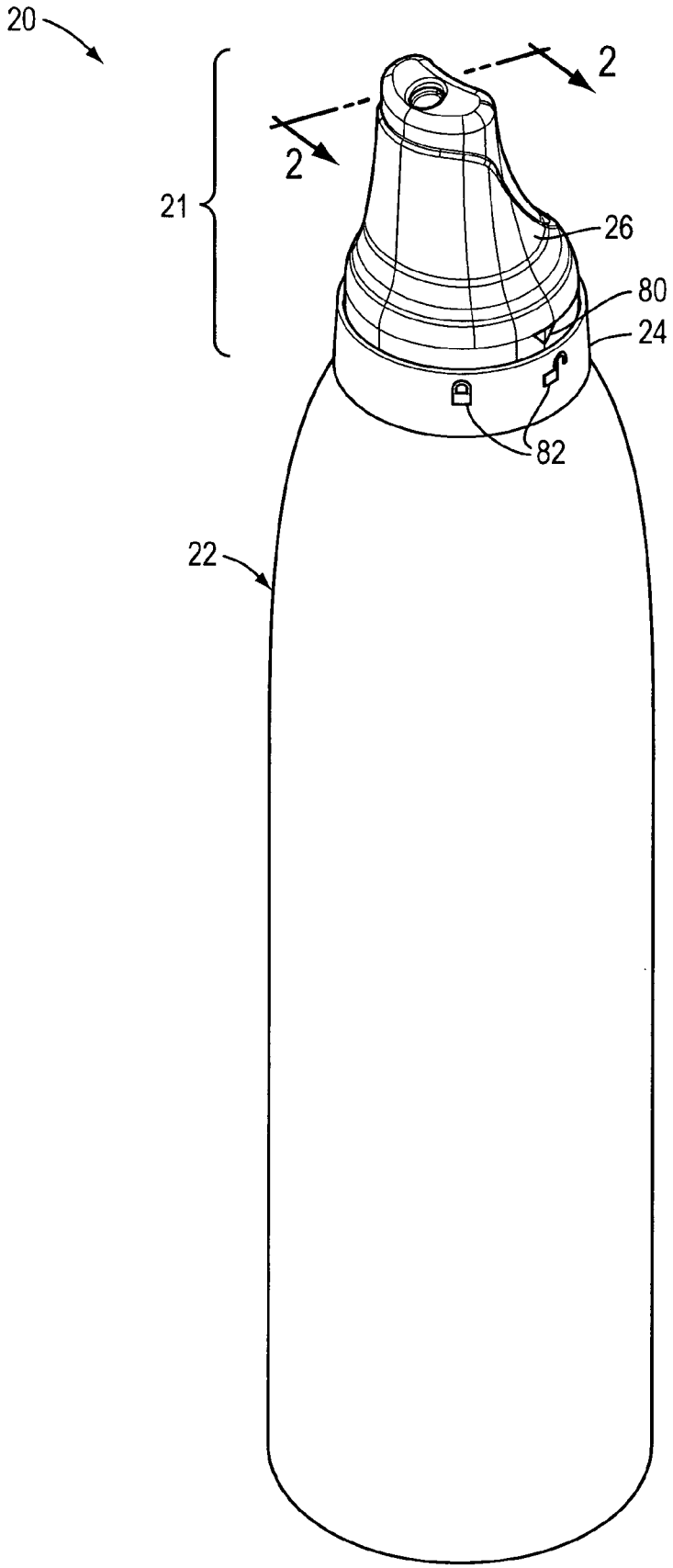
FIG. 1 is an isometric view of a hand-held, finger-operable dispensing package incorporating a dispensing system that includes a valve assembly (not visible) together with a first embodiment of the dispenser of the present invention installed on a container of pressurized product, and the package is shown in FIG. 1 with the dispenser actuator in an unactuated and unlocked condition prior to use.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention are described, along with the container and valve, in a typical (upright) position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

As will be further described in detail, the present invention is directed to a lockable dispenser, such as for dispensing pressurized contents from an associated container. The dispenser of the present invention is particularly suited for non-spray dispensing of products, such as foamed hair mousse or the like. Notably, the configuration of the present dispenser facilitates convenient manipulation by consumers in an inverted position, such as for application of hair care products. However, it is within the purview of the present invention that the present dispenser also can be readily configured for spray or atomized dispensing of products.

As will be further described, the present dispenser comprises a two-piece system including an upper actuator component, and a lower component in the form of a base which can be fitted to an associated container. To facilitate efficient storage and shipment of products having the present dispenser, the actuator of the dispenser is rotatable between locked and unlocked positions relative to the associated base, which is preferably rigidly fixed to a mounting cup of an aerosol valve mounted on the associated container.

Efficient assembly of the dispenser with an associated container is facilitated by the provision of a snap-fit between the base of a dispenser and the associated container. A preferred embodiment of the actuator of the dispenser is provided in the form of an outer shell with an orifice, while the inside of the actuator includes a snap-fit bead for assembly with the associated base, a "clicker" arm or projection for actuation in association with rotation of the actuator on the base, a locking arm, and a contact arm for actuating the associated valve through contact with the base.

The base of the dispenser includes a mounting or fixation ring to facilitate mounting of the dispenser on the mounting cup of the associated valve assembly. The base further includes a fixation arrangement in the preferred form of a snap-fit bead for snap-fit of the actuator to the base, with the defining a stem pocket for operatively fitting the base of the dispenser to the valve stem of the associated valve assembly. The base includes a flexible hinge member in the form of a connector element, and a generally elongated dispensing nozzle which is connected to the associated mounting ring by the flexible connector element.

As noted, in the preferred arrangement, actuator and base of the dispenser are fitted together by a rotatable snap-fit. When the actuator is in its "locked" position, the actuator will not actuate, and dispensing of product is prevented. As will be described, the actuator includes a locking element which cooperates with the mounting ring of the dispenser base for locking the actuator against dispensing movement by resisting downward motion of the actuator.

Simple turning of the actuator relative to the base moves the actuator to its unlocked position for dispensing product from the associated container. In the unlocked position, the locking element of the actuator is rotated to a position where the locking element can travel downwardly into a slot defined by the mounting ring of the base, thereby permitting generally downward movement of the actuator, which in turn acts against the flexible connector of the base and the associated nozzle. The actuator defines an actuation region in the form of a finger pad, which permits a user to readily manipulate the actuator, with a contact arm of the actuator contacting the flexible connector of the base at a cantilevered position, thereby desirably offering a mechanical advantage to move the valve stem of the associated valve assembly, and allow product to be dispensed though the nozzle of the base of dispenser. Product flowing through the nozzle of the base flows through an opening defined by the actuator for dispensing.

When the actuator of the preferred form of the dispenser is rotated to its locked position, the end of the dispensing nozzle in the base is hidden under a portion of the top of the actuator.

In the preferred form, a "door" or shield member or shield element is provided which is attached adjacent to the end of the nozzle, with the shield member being positioned under the actuator discharge opening in the locked position of the actuator. The closed "door" at the discharge opening of the actuator closes off the opening, promotes cleanliness, and stops product from moving through the discharge opening, such as in the case of a foamed mousse product or the like. The "closed or unclosed" feature desirably acts to secure the dispenser, with stop surfaces defined by the mounting ring of the base desirably acting to resist rotational movement of the actuator beyond its locked and unlocked orientations.

In the first illustrated embodiment, the present dispenser is configured so that a user can manipulate the finger pad on the actuator while the dispenser and associated package is in the use position. Generally sideways or lateral movement of the top of the actuator permits the actuator to move generally pivotably downwardly relative to the base of the dispenser. As will be described, this pivoting action is created by a bridging of the snap bead at the bottom edge of the actuator across two perpendicularly projecting ribs, or a solid shelf, on the dispenser base. As the actuator pivots about the base bridging, an arm inside the actuator contacts a point on the flexible connector of the base. This contact turns into a vertically downward motion that also drives the stem of the aerosol valve downwardly. The downward movement of the valve stem results in flow ports in the stem being exposed (moved downwardly away) from the associated valve gasket. Pressurized product in the aerosol container travels upwardly through the valve stem, into the nozzle of the dispenser base, and out the product-discharge orifice of the nozzle. During this action, the base of the dispenser remains firmly attached to the mounting cup of the aerosol package. The aerosol valve used in this embodiment can be of a vertical-style or a tilt/toggle-style, but it will be appreciated that for this embodiment, the valve is vertically actuated.

In a second embodiment, the hinge or flexible connector of the base of the dispenser is relatively repositioned to the front of the package. By this arrangement, the user actuates the dispenser by applying a downward load at the base of the finger pad of the actuator. This downward load causes a generally downward movement of the actuator relative to the associated base, with downward, generally pivotal movement of the actuator relative to the base being effected. As will be appreciated from the following detailed description, the second embodiment of the present dispenser differs from the first embodiment in that the hinge of the base is moved to the front of the base, and actuation by the user is generally rearwardly downward, rather than generally forwardly sideways. As in the previous embodiment, the aerosol valve used in this embodiment can be of a vertical-style or a tilt/toggle-style, but for this embodiment, the valve is vertically actuated.

In a third embodiment, downward non-pivotal actuation, rather than sideways or pivotal actuation, is provided. In this embodiment, the dispenser actuator moves generally non-pivotably downward relative to the associated base, in distinction from the first and second embodiments. Because the downward motion of the actuator relative to the base is not pivotal, the hinge or flexible connector of the base can be positioned at either the front or back of the base of the dispenser. The aerosol valve used in association with this embodiment can be of a vertical-style or a tilt/toggle-style, but the action of the valve is vertically actuated.

In a fourth disclosed embodiment, the dispenser is similar to the first embodiment, but the associated valve is a tilt/toggle-style that is side-actuated. The valve is actuated by a true tilt motion. Additionally, the hinge or flexible connector on the base of this embodiment has an s-shape or serpentine cross-section to allow the hinge to move sideways when needed. This sideways projection allows a stem pocket of the dispenser base, provided at the base of the nozzle, to move the with the tilting of the valve stem during actuation of the valve. In this embodiment, a contact arm of the actuator actuates the nozzle of the associated base with a sideways motion, with this sideways motion providing the desired motion to open the associated tilt/toggle-style valve.

Figure 1A:
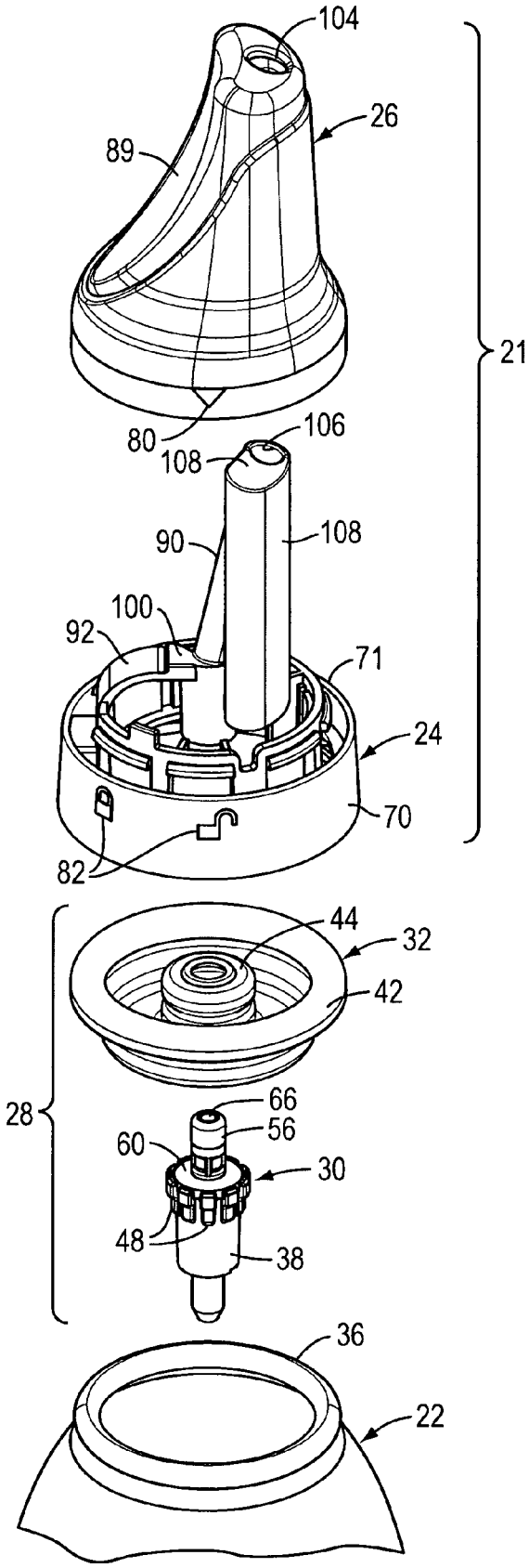
FIG. 1A is an exploded isometric view of the package shown in FIG. 1 with only a fragmentary, upper portion of the container being illustrated.

FIG. 1 illustrates a package 20 employing a presently preferred, first embodiment of a finger-operable dispenser 21 of the present invention in which the dispenser 21 is installed on a container 22. With reference to FIG. 1A, the first embodiment dispenser 21, per se, includes a base 24 and an actuator 26. The actuator 26 may alternatively be described as a "button." The dispenser 21 cooperates with a valve assembly 28 comprising a valve 30 and valve mounting cup 32. (In an alternate embodiment (not shown), the valve assembly 28 could also include a dip tube extending downwardly from the valve 30 into the container 22.) The combination of the dispenser 21 and valve assembly 28 may be defined as a "dispensing system" which can be assembled to the container 22 containing a pressurized fluent product (not visible in the figures) so as to provide the complete package 20, per se.

The container 22 is adapted to hold a product (e.g., a liquid or other fluent substance (not shown)) below the valve assembly 28. Typically, the upper end of the container 22 and a portion of the dispenser 21 can be conveniently held in the user's hand. The container 22 is typically a metal can having an upper edge rolled into a mounting bead 36 (FIGS. 1A and 2) for receiving the valve mounting cup 32 crimped thereto.

Figure 2:
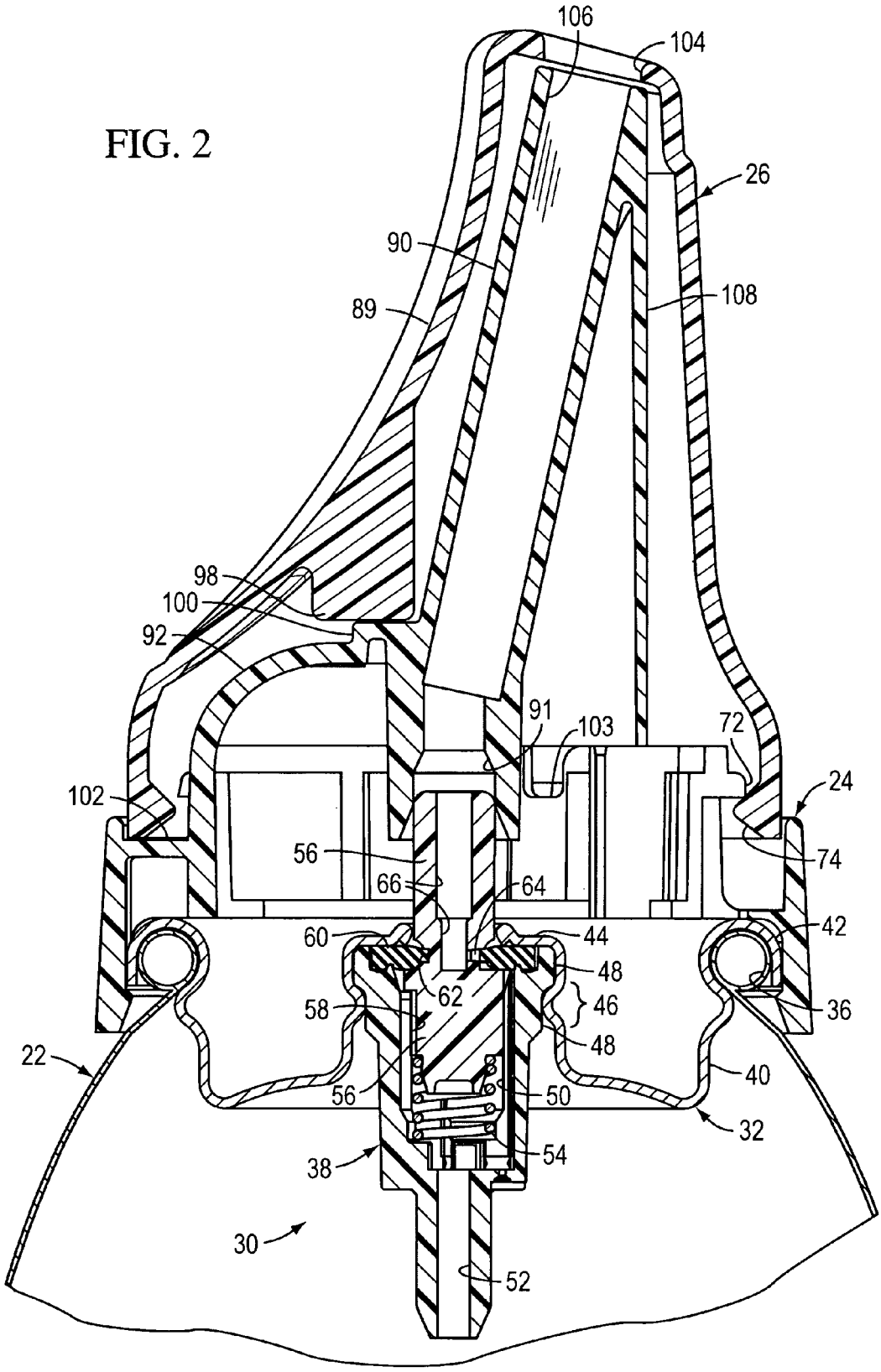
FIG. 2 is a greatly enlarged, fragmentary, cross-sectional view taken generally along the plane 2-2 in FIG. 1.
Figure 3:
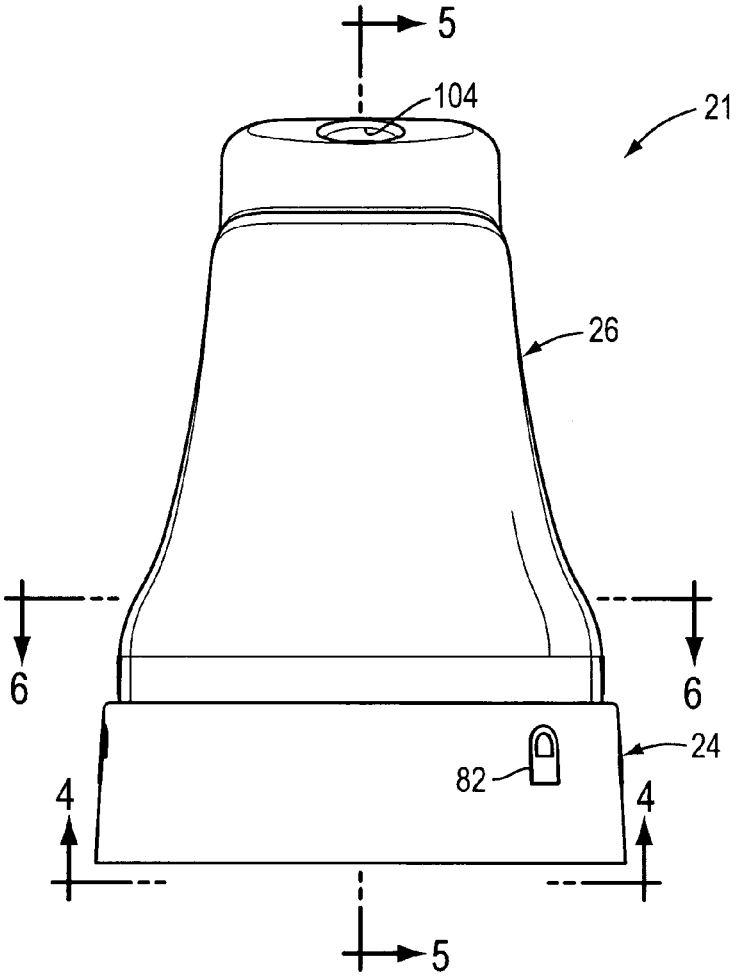
FIG. 3 is a greatly enlarged, front, elevational view of the first embodiment of the dispenser of the present invention shown in FIG. 1, but in FIG. 3 the dispenser is shown prior to installation on a valve assembly and container.
Figure 4:
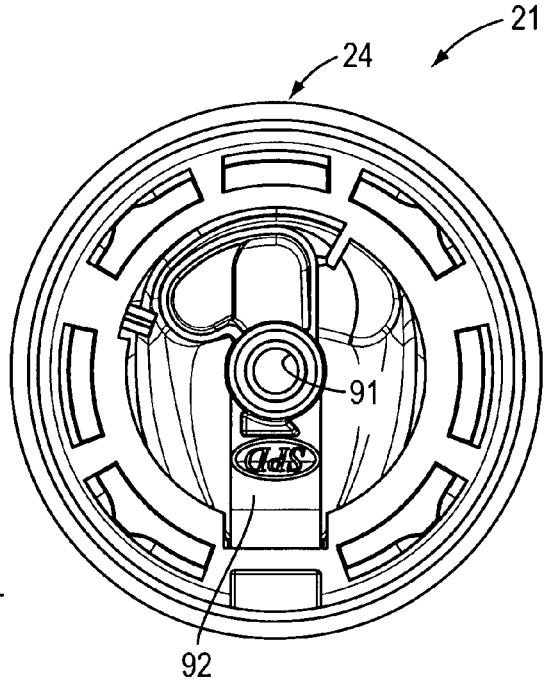
FIG. 4 is a bottom view of the dispenser taken generally along the plane 4-4 in FIG. 3.
Figure 5:
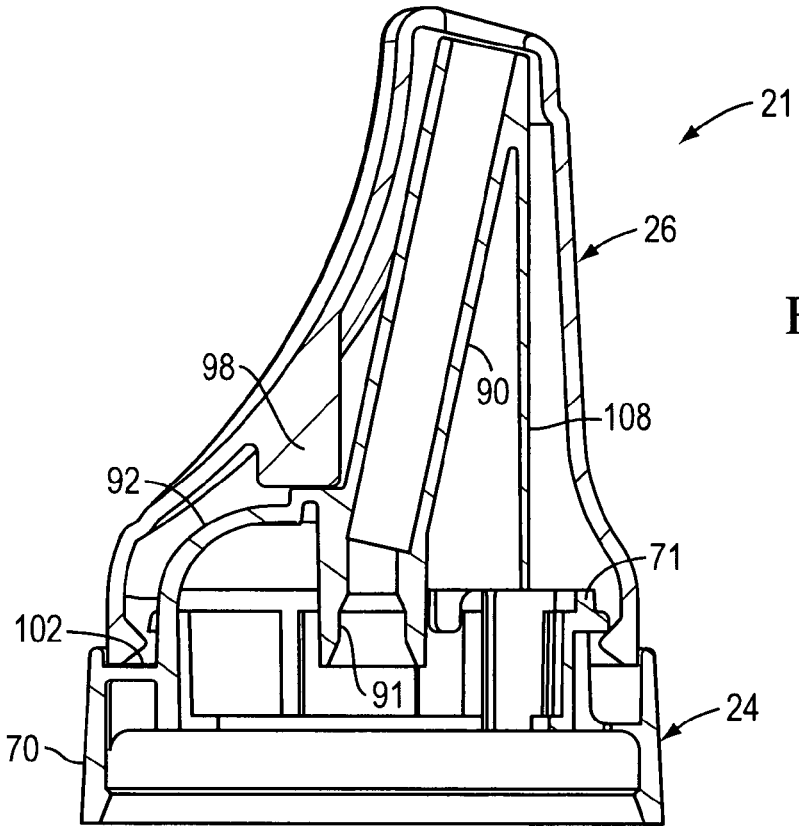
FIG. 5 is a cross-sectional view taken generally along the plane 5-5 in FIG. 3.
Figure 6:
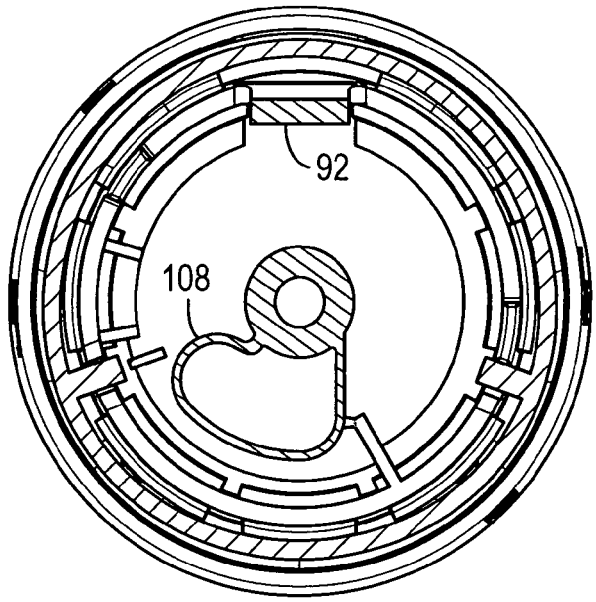
FIG. 6 is a cross-sectional view taken generally along the plane 6-6 in FIG. 3.

The aerosol dispensing valve 30 has a body 38 (FIGS. 1A and 2). A part of the aerosol dispensing valve body 38 typically extends into the opening at the top of the container 22.

The aerosol dispensing valve 30 may be of any suitable conventional or special type, with or without a dip tube (not shown). One conventional type of valve 30 is the vertical style wherein the valve opens when an upper part of the valve is pushed inwardly, and that is the type that is illustrated in the FIGS. 1-49. Another conventional type of valve opens when an upper part of the valve is pushed so as to tilt the upper part of the valve relative to the valve body, and the present invention can be adapted to function with that type of valve as shown in FIGS. 50-56.

With reference to FIGS. 1A and 2, the conventional vertical style valve 30 is mounted in the conventional valve mounting cup 32 which is made of a suitable metal and which has a mounting flange 40 (FIG. 2) with an outer peripheral portion 42 that can be crimped about the container opening bead 36 to provide a secure attachment of the mounting cup 32 to the top of the container 22.

The mounting cup 32 includes an annular inner wall 44 (FIG. 2) which defines an opening through which a portion of the valve 30 projects. The mounting cup annular inner wall 44 includes a crimp 46 (FIG. 2) for engaging exterior portions of castellations or ribs 48 (FIG. 1A) on the exterior of the valve body 38 of the valve 30.

As can be seen if FIG. 2, the body 38 of the valve 30 defines an interior chamber 50 which has a bottom end that is open through a passage 52 in the body 38 to the pressurized contents in the container 22. The container 22 typically holds a liquid product (or other fluent substance product) which is pressurized by a propellent gas.

With continued reference to FIG. 2, a compression coil spring 54 is disposed in the valve body interior chamber 50 along with an overlying stem 56 which is normally biased upwardly to the top of the chamber 50 by the spring 54. The valve body 38 includes vertical ribs 58 in the chamber 50 defining flow passages between them which extend from the bottom portion of the chamber 50 to the upper portion of the chamber 50 which is covered by a gasket 60 retained by the mounting cup 32 at the top of the valve body 30. The radial outer periphery of the gasket 60 is clamped between the upper end of the valve body 38 and the top, inner, annular edge of the mounting cup 32.

The valve stem 56 defines an annular groove 62 for receiving the inner periphery of the gasket 60 in a seated or sealing relationship when the stem 56 is normally biased to the elevated (i.e., upward or outward), unactuated, closed position (FIG. 2). The part of the valve stem 56 radially inwardly of the annular groove 62 defines a radial or lateral port 64 extending generally radially between the groove 62 and an internal, vertical passage 66 that is open at the top end of the stem 56 and that is adapted to communicate with the dispenser actuator 26 as described hereinafter.

When the valve stem 56 is moved downwardly by the actuator 26 (as explained in detail hereinafter) to the actuated, open position (FIG. 26), the valve stem lateral port 64 moves away from (below) the gasket 60 which becomes disengaged from its seated, sealing relationship in the valve stem annular groove 62, and the pressurized fluent substance product can flow from the interior of the container 22 and through the above-described passages of the valve 30 through the base 24 and actuator 26. When the valve stem 56 is allowed to return to the elevated, closed position under the influence of the biasing spring 54, the flow passages are occluded by the gasket 60, and the flow stops.

It will be appreciated that the particular valve 30 (with or without a dip tube or suction tube (not shown)) may be of any suitable design for dispensing a product from the container 22 and out through the valve stem 56. With the understanding that the actuator 26 of the inventive dispenser 21 is adapted to be connected to a suitable valve actuating stem (e.g., valve stem 56), it will be appreciated that the detailed design and construction of the dispensing valve 30 per se form no part of the broad aspects of the present invention.

The dispenser base 24 is adapted to be snap fit on the container 22 over the flange 42 mounting cup 32 as shown in FIG. 2. The base 24 has a novel configuration as will next be explained.

As previously noted, actuator 26 of dispenser 21 is fitted to the associated base 24 by a snap-fit that provides limited, relative rotational movement of the actuator with respect to the base between a first rotated position, which prevents downward movement of the actuator relative to the base, and a second rotated position, which permits generally downward movement of the actuator. To this end, the base 24 includes an annular collar 70 for fitment to container 22 by snap-fit securement to the portion 42 of mounting cup 32 secured to bead 36 (FIG. 2). The base 24 further includes a mounting ring 71 (FIGS. 7 and 7A) having a plurality of circumferentially spaced snap-fit elements 72 for snap-fit cooperation with snap-fit elements 74 (FIGS. 2 and 14) provided on a proximal portion of actuator 26. Cooperative interengagement of the snap-fit elements 72 and 74 securely retain the actuator 26 on the base 24, while permitting limited, relative rotation therebetween.

As noted, the actuator 26 is rotatable relative to the base between a first, locked position, which locks the actuator against relative downward movement with respect to the base, and a second, unlocked or actuatable position, which permits generally downward movement of the actuator for dispensing product from the associated container 22. To this end, one of the base 24 and the actuator 26 defines at least one locking element, and the other one defines at least one stop surface, so that engagement between the locking element and the stop surface limits rotational movement of the actuator relative to the mounting ring. In this illustrated embodiment, actuator 26 includes a pair of locking elements 76, respectively engageable with a pair of stop surfaces 78 provided on the mounting ring 71 of base 24. By this arrangement, respective engagement of the locking elements with the stop surfaces acts to define the range of rotational movement of the actuator 26 with respect to the base 24, as the actuator is rotatably moved between its first and second positions with respect to the base. In this regard, the actuator 26 can include position indicia 80 (FIGS. 1 and 13), with the base 24 including position indicia 82 to provide a convenient indication to users of the relative position of the actuator with respect to the base.

To further facilitate a convenient use by consumers, the present dispenser preferably includes an arrangement whereby at least one of an audible indication and a tactile indication are provided to a user attendant to rotation of the actuator 26 with respect to the base 24. In the illustrated first embodiment, this position-indicating arrangement is provided by a flexible, position-indicating projection 84 (FIGS. 14, 32, and 35) on the actuator 26, with the base 24 including a pair of deflectors 86 (FIGS. 7A, 32, and 35) respectively engageable with the position-indicating projection 84. In the preferred form, the deflectors 86 and projection 84 cooperate to provide readily discernable, tactile and audible indication of movement of the actuator 26 on the base 24 between its first and second positions.

In accordance with the present invention, dispenser 21 is configured to effect dispensing of product from the associated container by generally downward movement of actuator 26 with respect to base 24. In this embodiment, actuator 26 is generally downwardly pivotably movable with respect to base 24, in the unlocked position of the actuator, by which movement, operative connection of the actuator with the associated valve 30 effects dispensing of product from container 22 through the dispenser 21. The actuator 26 defines a finger pad or actuation region 89 (FIGS. 1A, 2, 15, 19, 26, 27, and 29) against which the user can push with a finger to apply an actuation force as indicted by the arrows 93 in FIGS. 25, 26, 27, and 29.

To this end, base 24 further includes a generally elongated nozzle 90 (FIGS. 2 and 7-12) which is flexibly connected to the mounting ring 71 by a hinge-like, flexible connector element 92 (FIGS. 2 and 7-12). In this illustrated embodiment, flexible connector 92 has the generally arcuate configuration, and accommodates generally pivotal deflection of nozzle 90 with respect to mounting ring 70 of the base 24.

Figure 26:
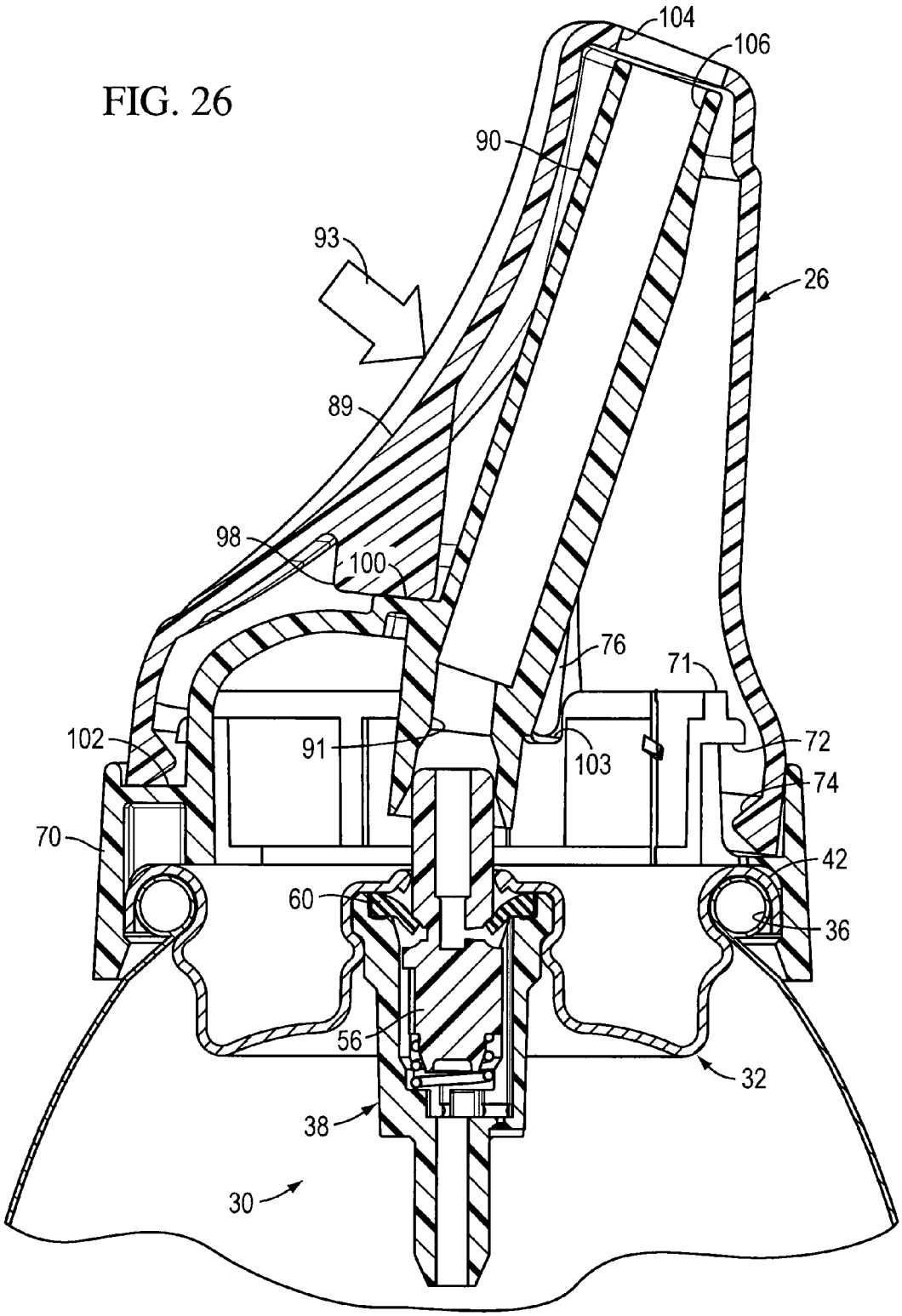
FIG. 26 is an enlarged, cross-sectional view taken generally along the plane 26-26 in FIG. 25, but in FIG. 26, only an upper fragmentary portion of the container is shown.
Figure 27:
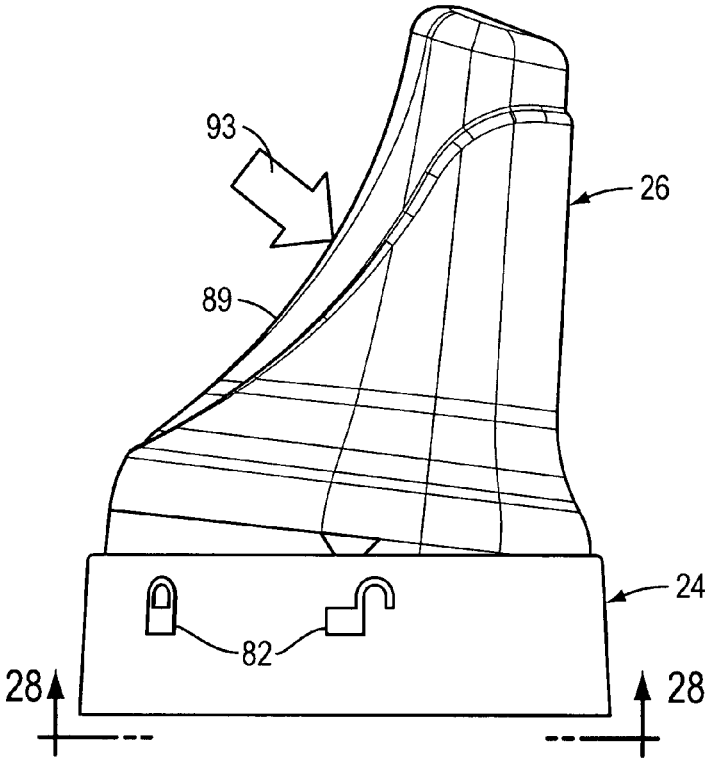
FIG. 27 is a side elevational view of the dispenser with the container and valve assembly omitted and showing an actuation force moving the dispenser actuator to the actuated position.
Figure 28:
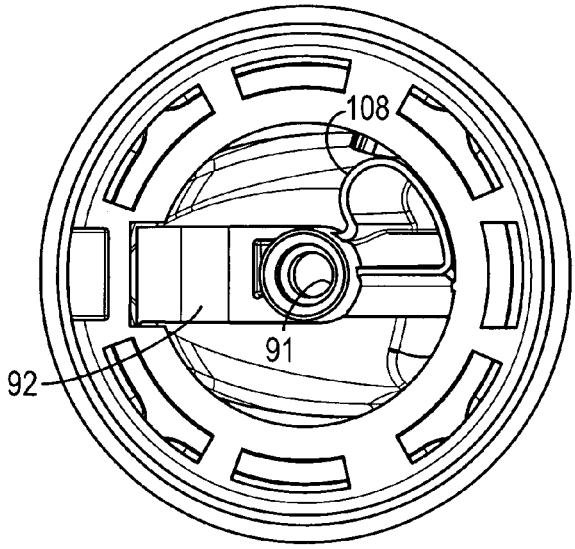
FIG. 28 is a bottom view of the dispenser taken generally along the plane 28-28 in FIG. 27.
Figure 29:
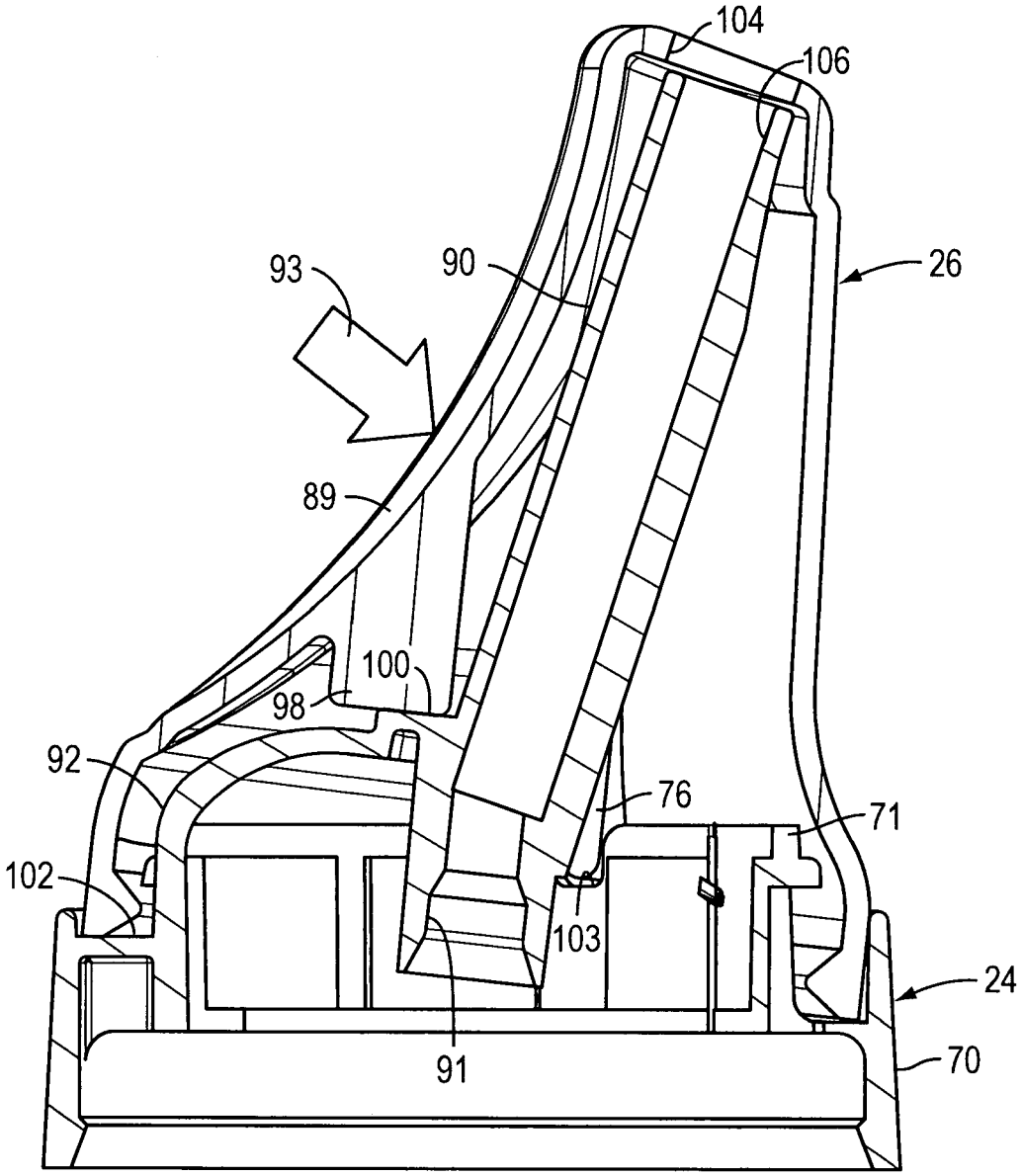
FIG. 29 is a cross-sectional view similar to FIG. 26, but FIG. 29 omits the container and valve assembly.
Figure 30:
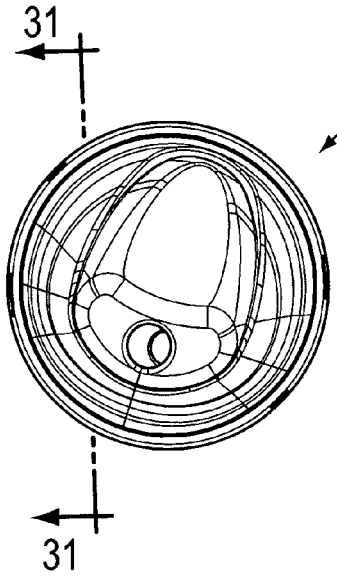
FIG. 30 is a top plan view of the unactuated dispenser as the dispenser actuator is being rotated away from one end of its range of travel toward the other end of its range of travel, and in FIG. 30, the container and valve assembly have been omitted.
Figure 32:
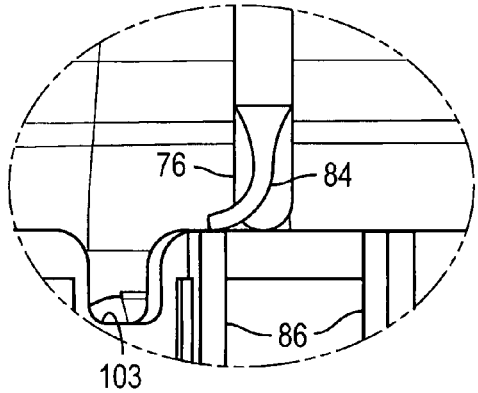
FIG. 32 is a greatly enlarged, fragmentary, cross-sectional view of the region in FIG. 31 which is enclosed by the circle designated "FIG. 32"
Figure 31:
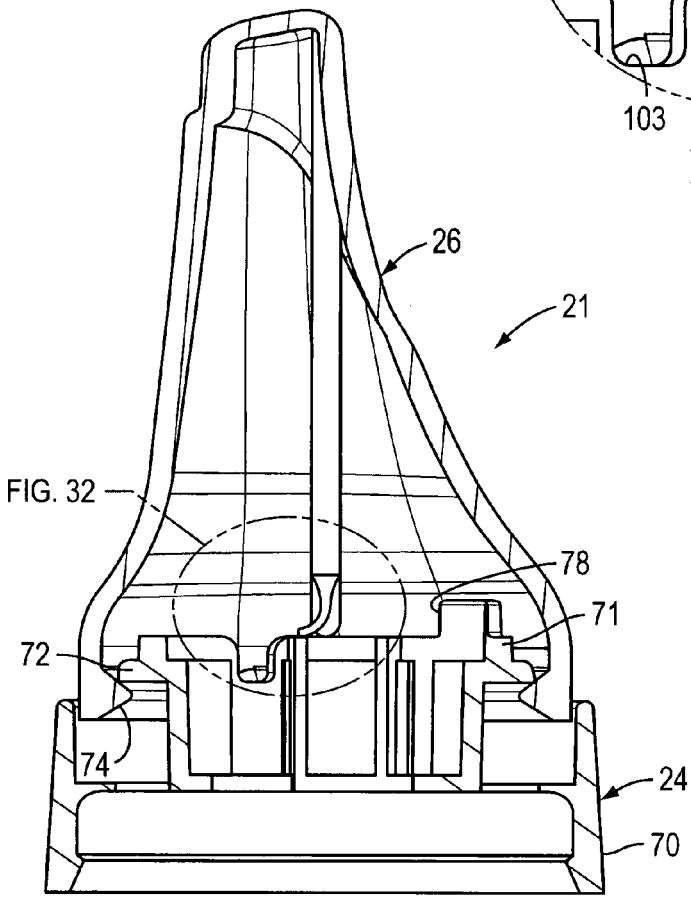
FIG. 31 is an enlarged, cross-sectional view taken generally along the plane 31-31 in FIG. 30 to show the deflectable tab of the actuator engaging and deflecting against the top of one of two ribs on the dispenser base near one end of the rotational travel range of the actuator.
Figure 33:
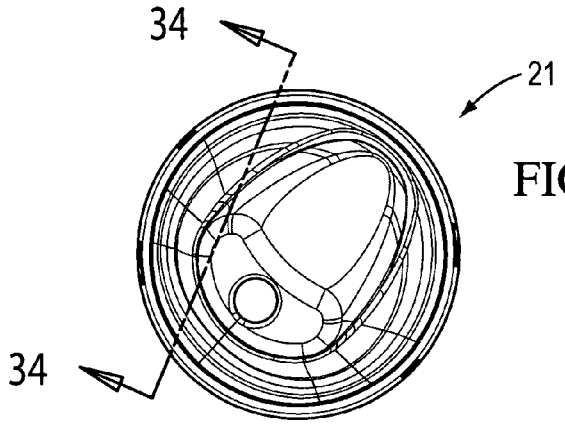
FIG. 33 is a view similar to FIG. 30, but FIG. 33 shows the unactuated dispenser as the dispenser actuator is being rotated to a position approaching the other end of the rotational travel range of the actuator.
Figure 35:
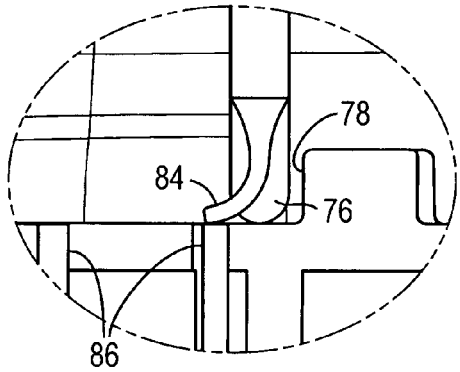
FIG. 35 is a greatly enlarged, fragmentary, cross-sectional view of the region in FIG. 34 enclosed in the circle designated "FIG. 35" in FIG. 34.
Figure 34:
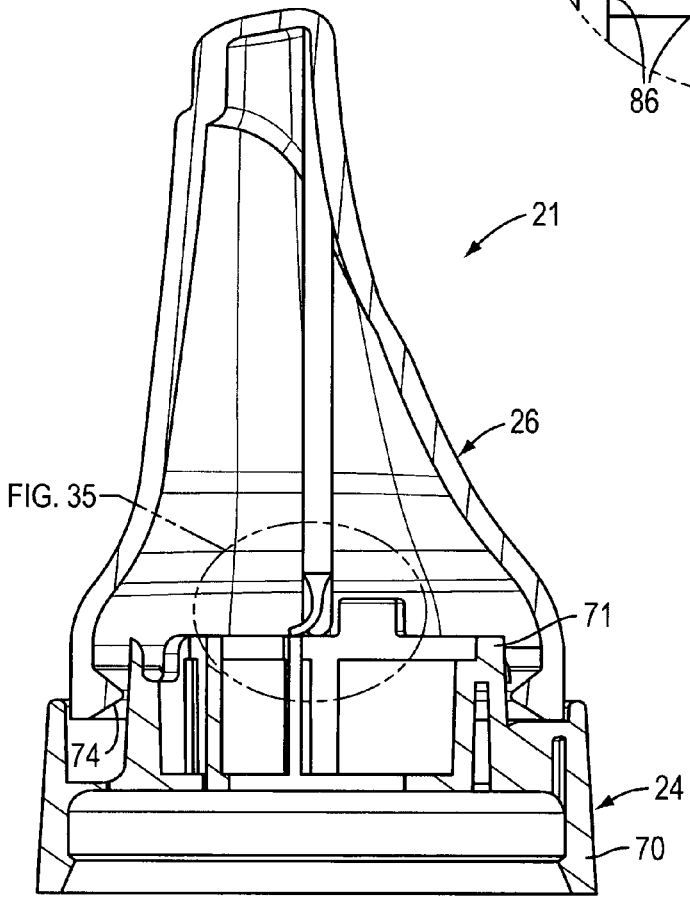
FIG. 34 is an enlarged, cross-sectional view taken generally along the plane 34-34 in FIG. 33 to show the deflectable tab of the actuator engaging and deflecting against the top of the second of the two ribs in the dispenser base.
Figure 36:
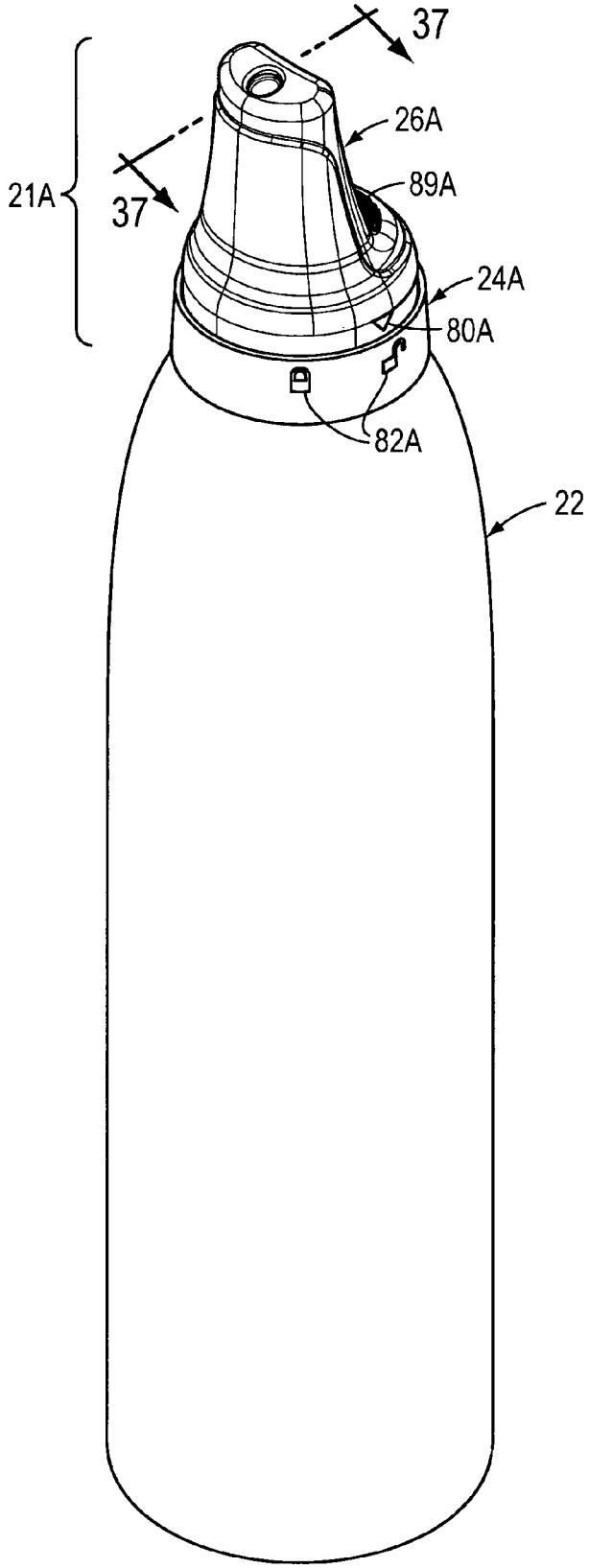
FIG. 36 is an isometric view of a hand-held, finger-operable dispensing package incorporating a dispensing system that includes a valve assembly (not visible) together with a second embodiment of the dispenser of the present invention installed on a container of pressurized product, and the package is shown in FIG. 36 with the dispenser actuator in an unactuated and unlocked condition prior to use.
Figure 37:
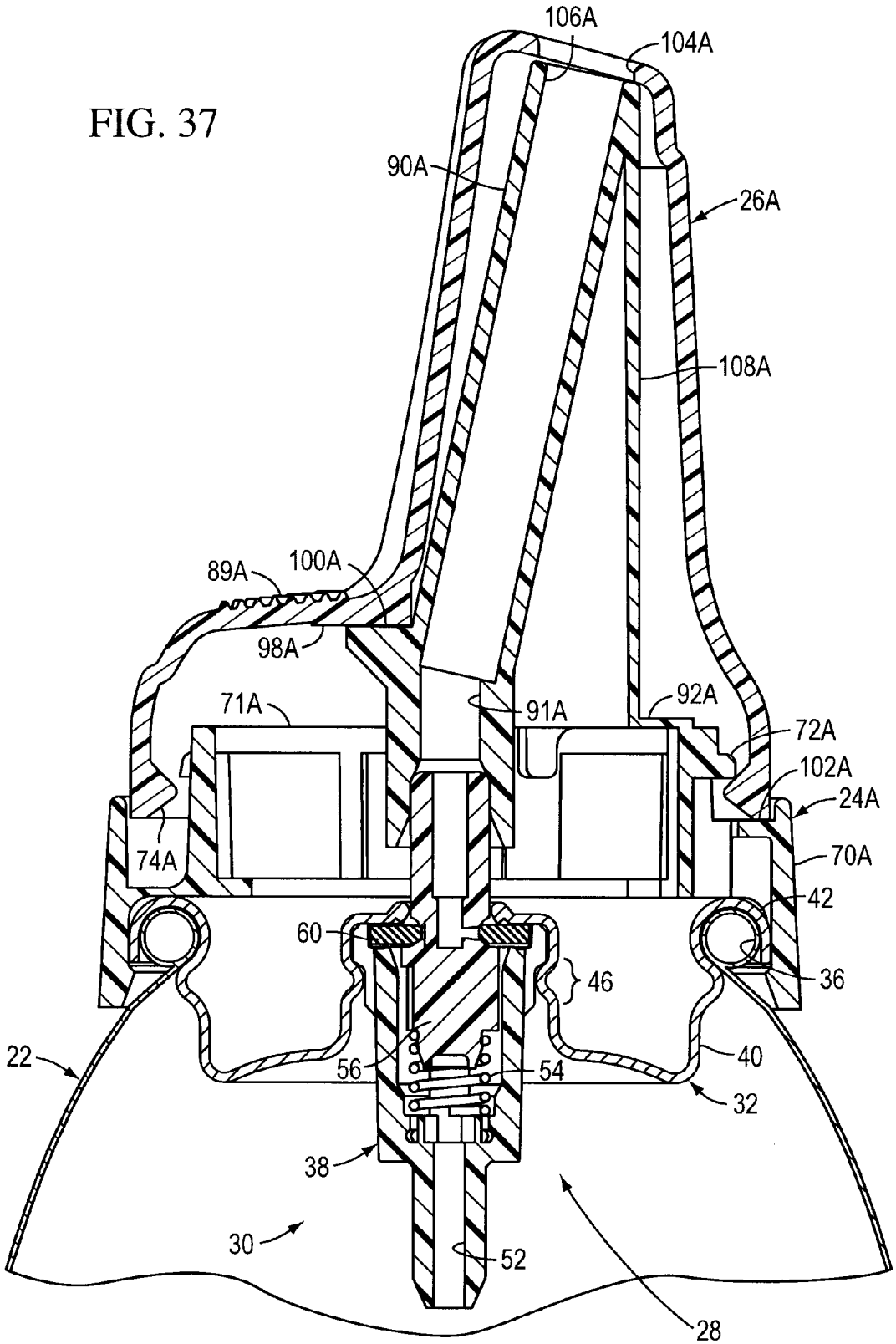
FIG. 37 is a greatly enlarged, fragmentary, cross-sectional view taken generally along the plane 37-37 in FIG. 36.

The nozzle 90 defines a stem pocket 91 (FIGS. 2, 5, 11, and 12) at the lower end thereof for cooperative engagement with valve stem 56 (FIG. 2), and for providing fluid communication between the valve 30 and the nozzle 90. Deflection of the nozzle 90 relative to the mounting ring 71 acts to open valve 30, such as illustrated in FIG. 26, wherein deflection of the nozzle 90 has effected downward, opening movement of stem 56 of the valve 30, whereby product can flow through the valve stem and into the nozzle 90.

As noted, downward movement of actuator 26 relative to base 24 effects the movement of nozzle 90 product-dispensing. To this end, the actuator includes an internal, downwardly projecting actuation member 98 (FIGS. 2, 17, 18, and 26) engageable with an abutment surface 100 (FIGS. 2, 7, 7A, 10, 12, and 26) defined by flexible connector 92.

Figure 7:
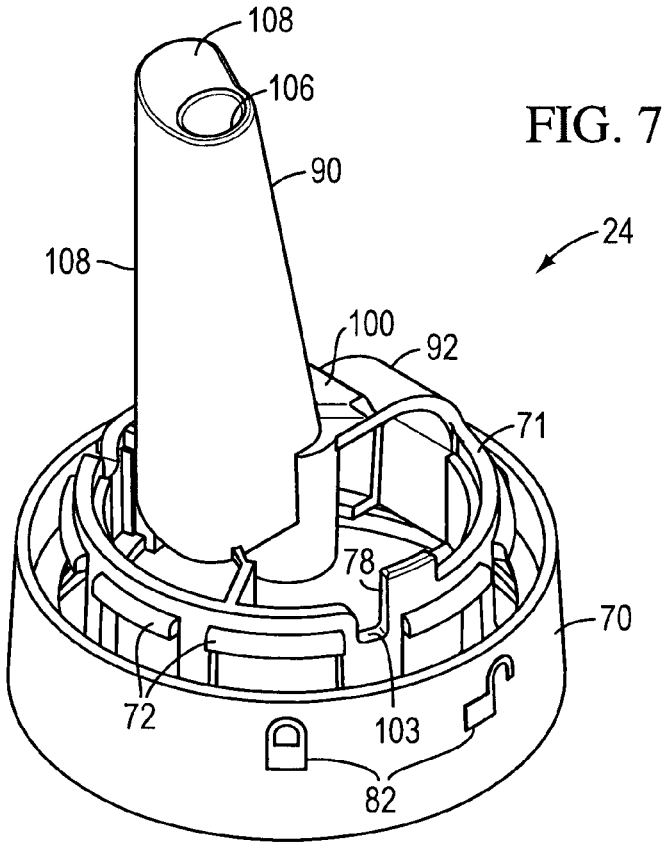
FIG. 7 is an isometric view of the base component or "base" of the first embodiment of the dispenser of the present invention viewed at an angle from the right side above the top and prior to assembly with the other components.
Figure 7A:
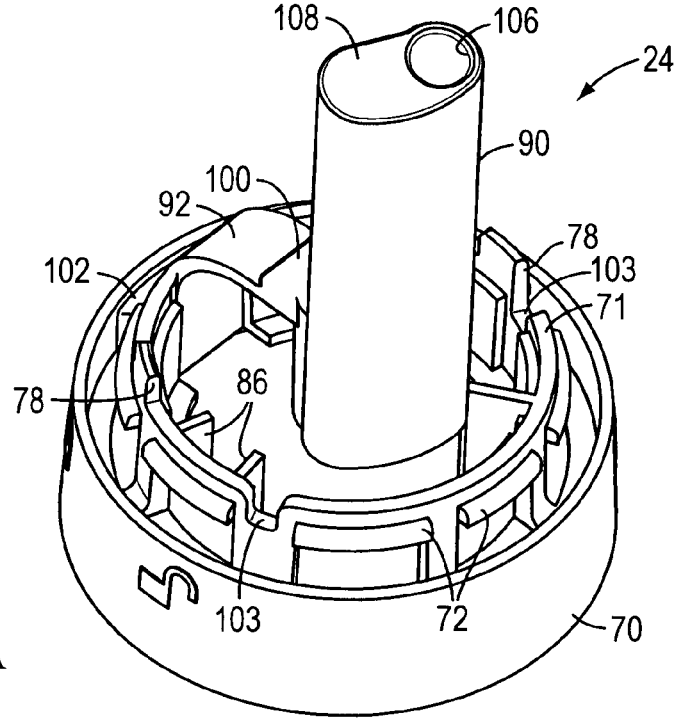
FIG. 7A is an isometric view similar to FIG. 7, but in FIG. 7A the base is viewed from a point on the upper left side of the base.
Figure 8:
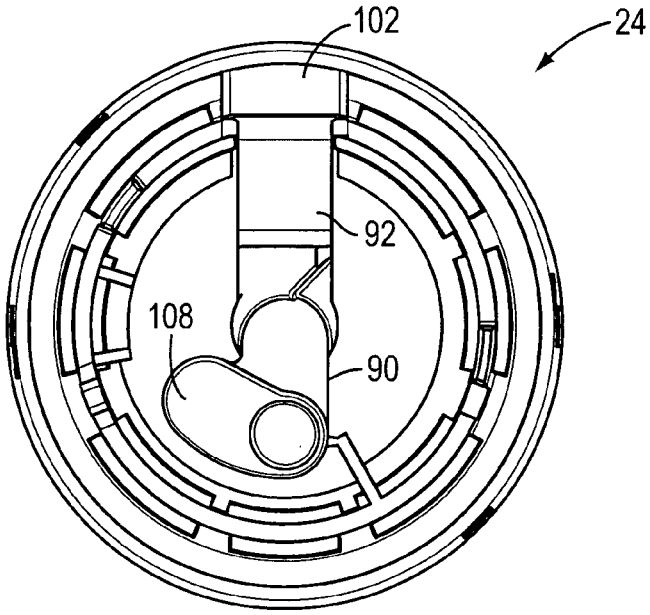
FIG. 8 is a top plan view of the base shown in FIG. 7.
Figure 9:
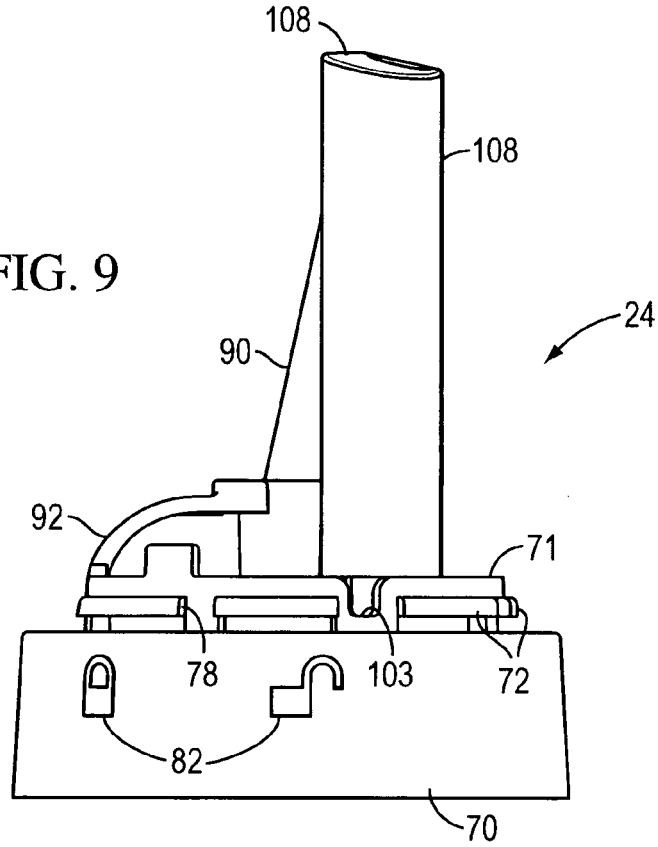
FIG. 9 is a left-side elevational view of the base shown in FIG. 7.
Figure 10:
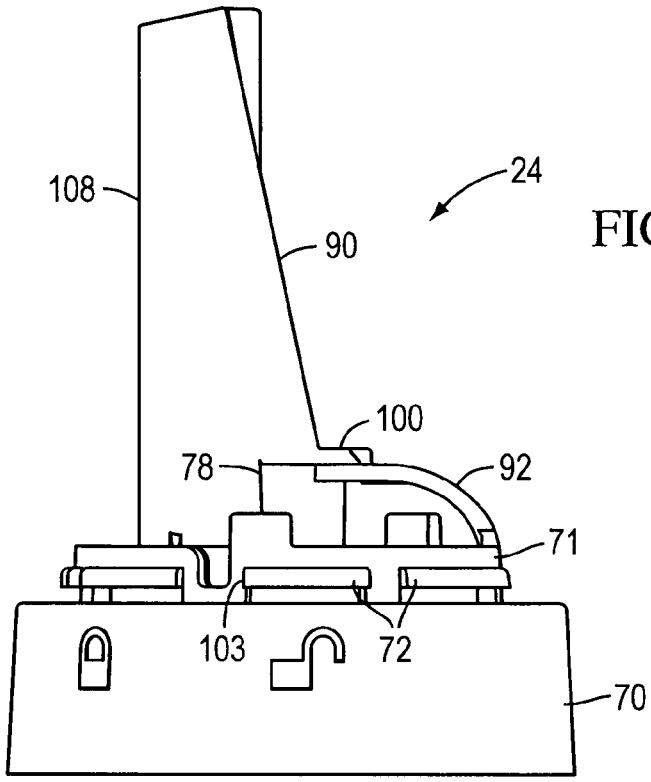
FIG. 10 is a right-side elevational view of the base shown in FIG. 7.
Figure 11:
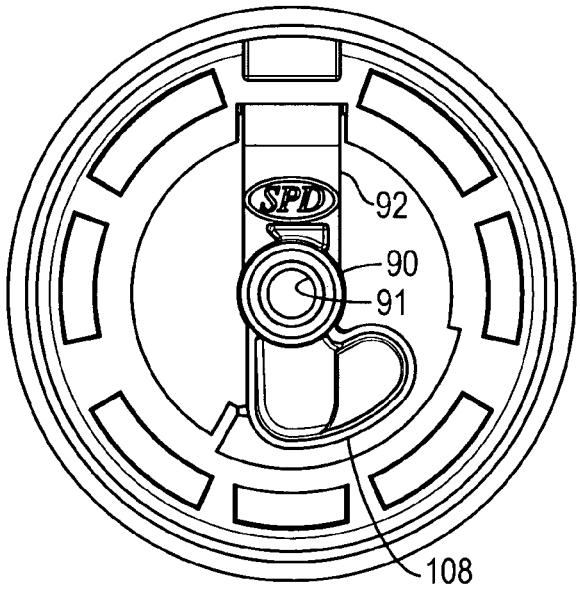
FIG. 11 is a bottom plan view of the base illustrated in FIG. 7.
Figure 12:
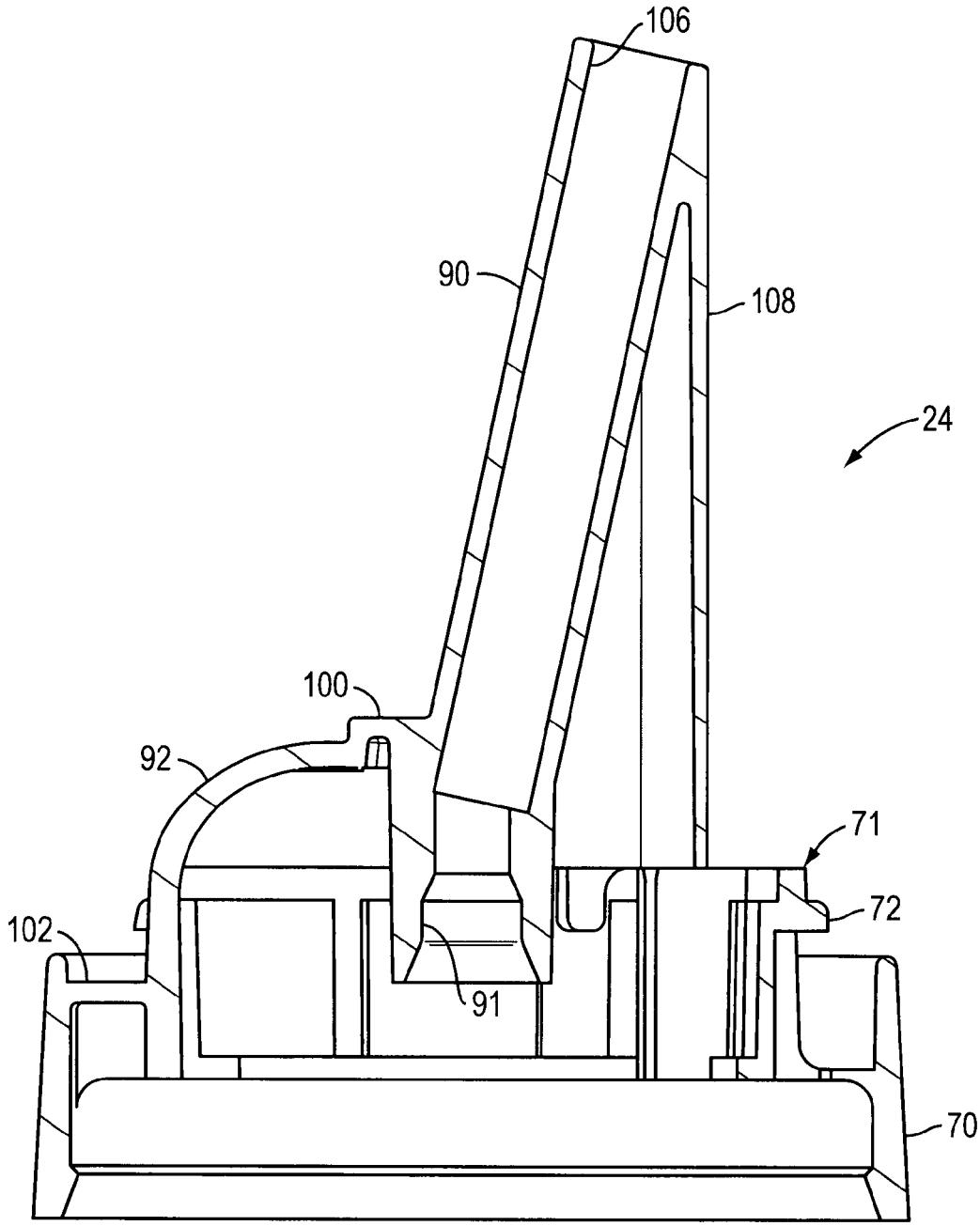
FIG. 12 is a cross-sectional view similar to FIG. 2 showing the base of the present dispenser.
Figure 13:
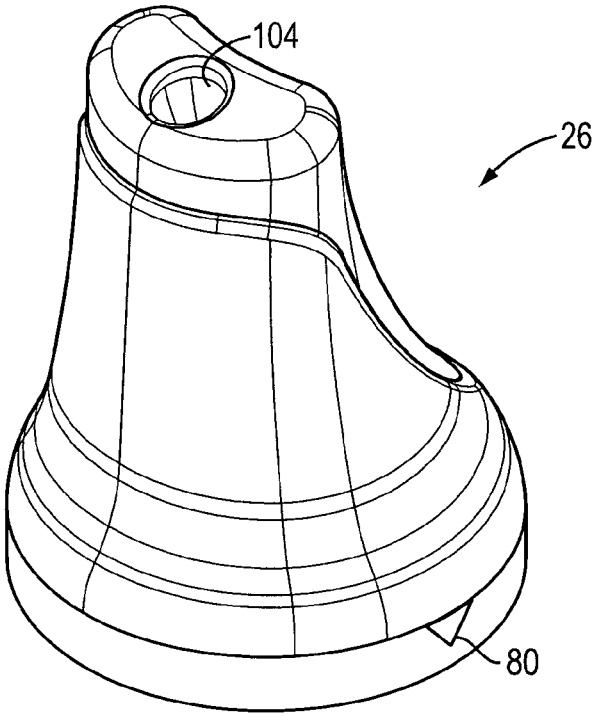
FIG. 13 is an isometric view of the actuator component or "actuator" of the first embodiment of the dispenser as viewed at an angle from above the top, discharge end and prior to assembly with the other components.
Figure 14:
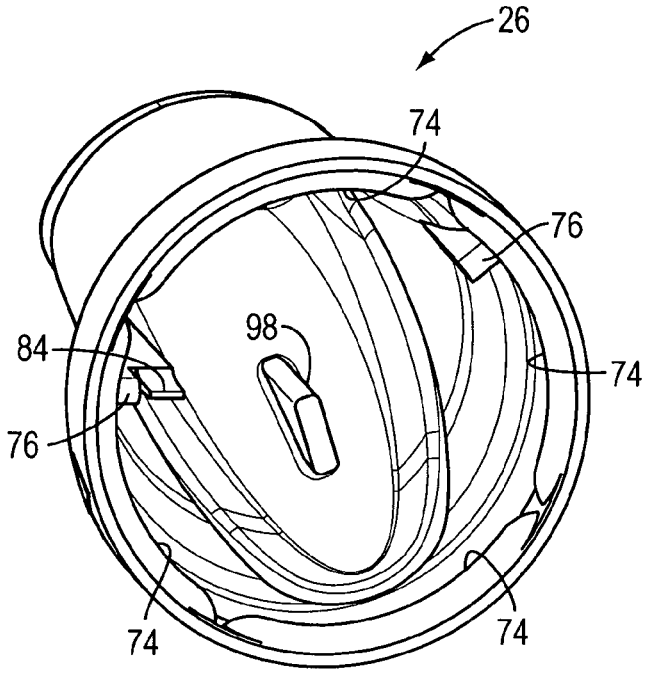
FIG. 14 is an isometric view of the actuator shown in FIG. 13, but in FIG. 14, the actuator is viewed at an angle from the bottom to illustrate interior details.
Figure 15:
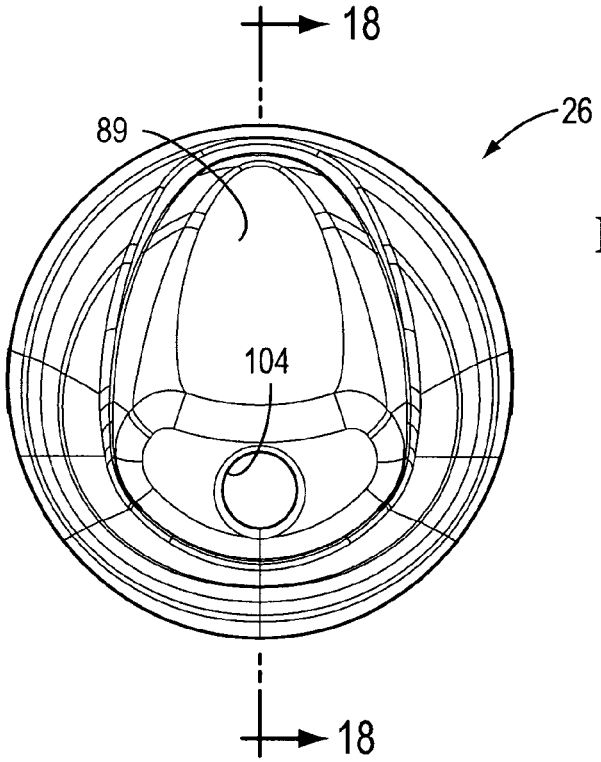
FIG. 15 is a top, plan view of the actuator shown in FIGS. 13 and 14.
Figure 16:
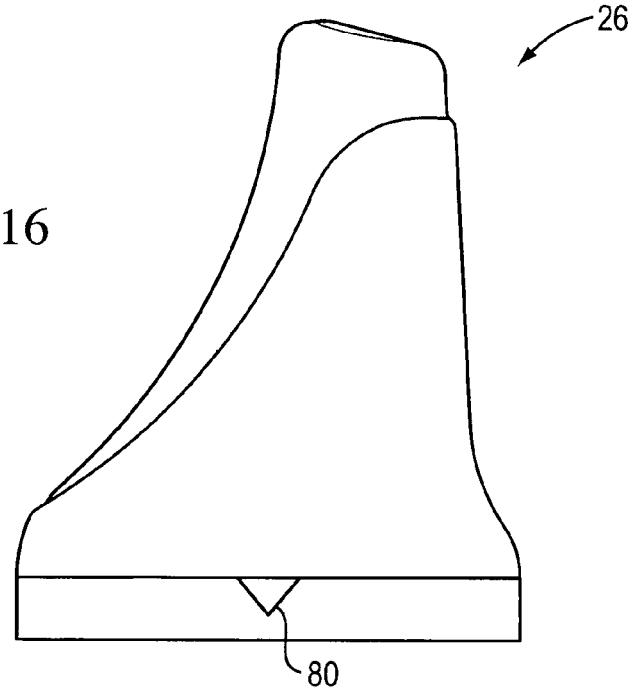
FIG. 16 is a left-side elevational view of the actuator shown in FIGS. 13 and 15, the right-side elevational view being a mirror image.
Figure 17:
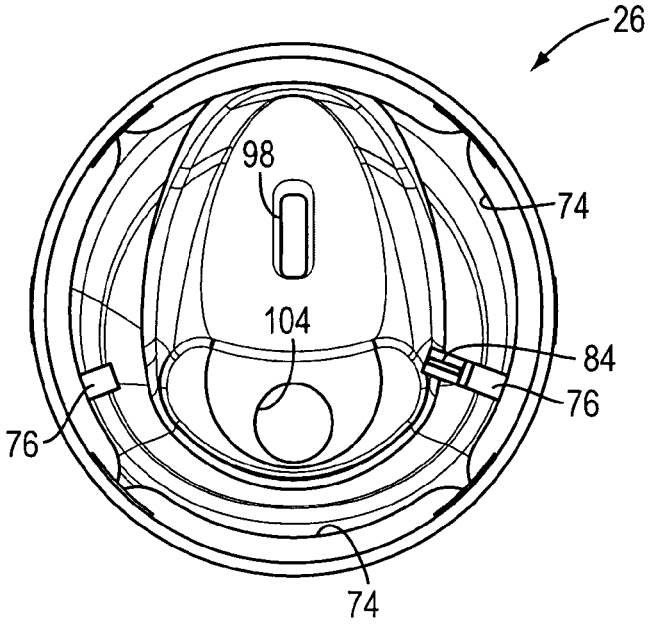
FIG. 17 is a bottom view of the actuator shown in FIG. 16.
Figure 18:
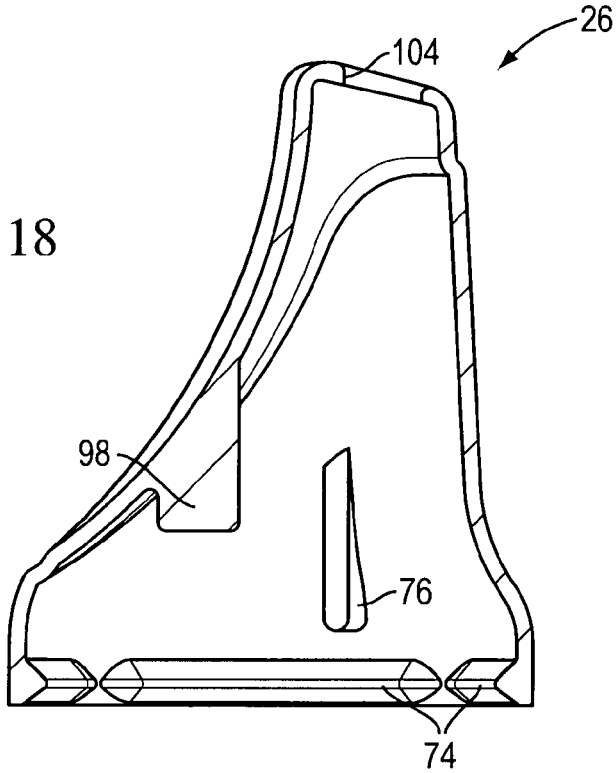
FIG. 18 is a cross-sectional view of the actuator taken along the plane 18-18 in FIG. 15.
Figure 19:
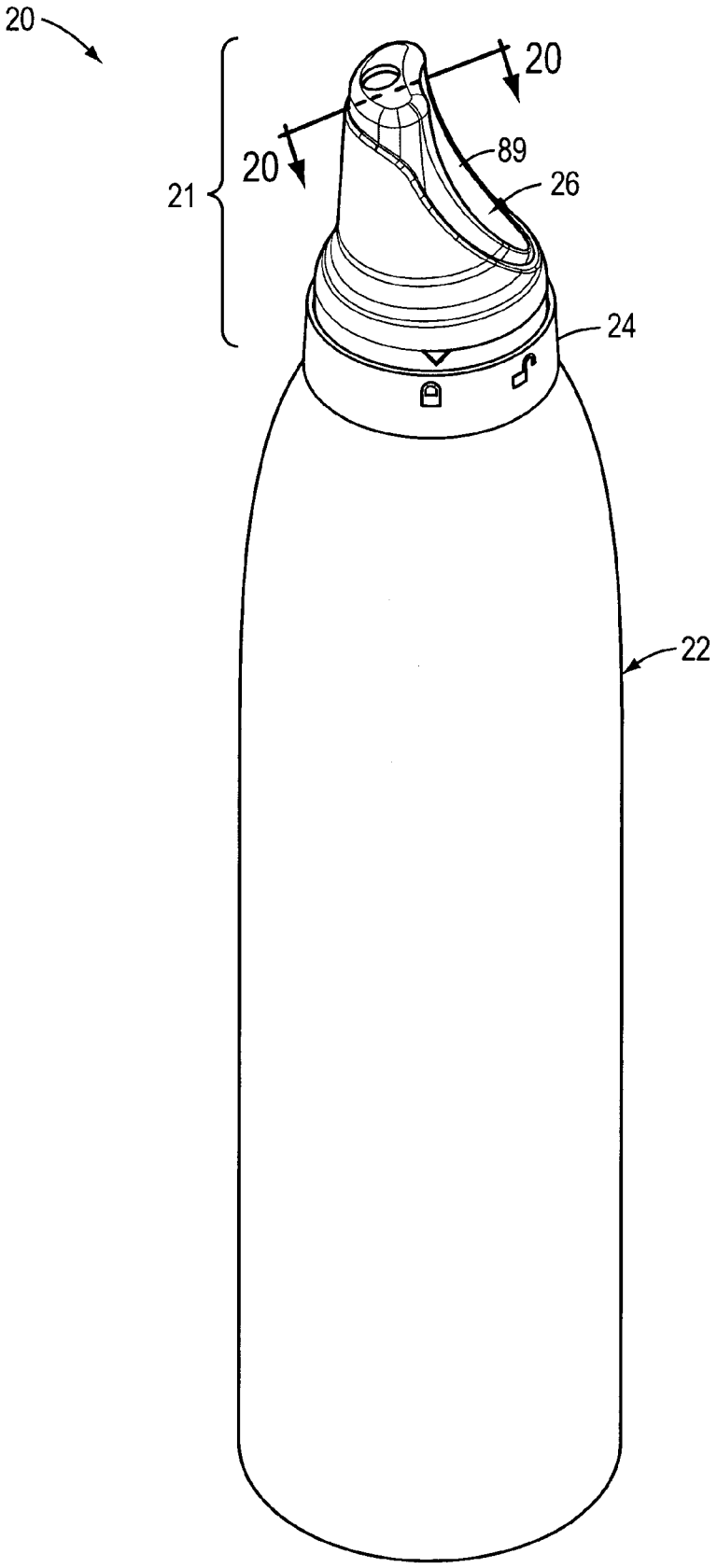
Figure 20:
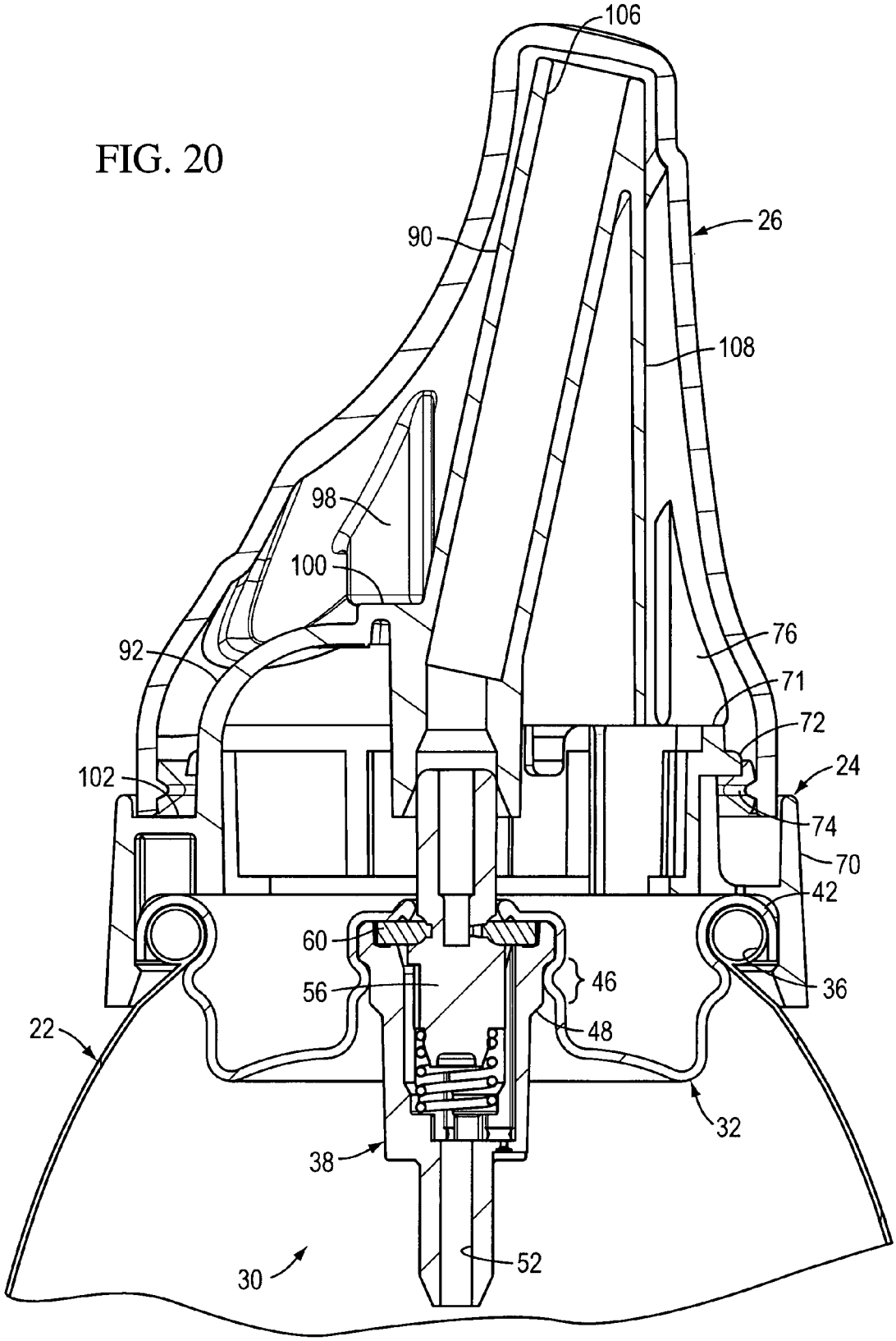
FIG. 20 is a cross-sectional view taken generally along the plane 20-20 in FIG. 19, and in FIG. 20 only a fragmentary, upper portion of the container is shown.
Figure 21:
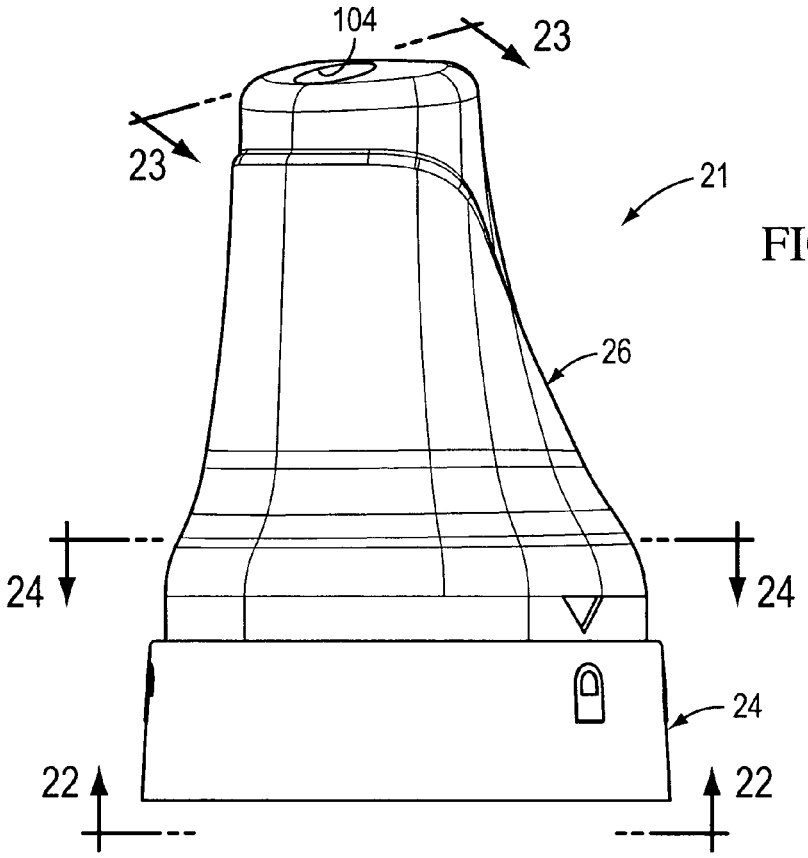
FIG. 21 is an enlarged, elevational view of the dispenser, but FIG. 21 omits the container and valve assembly.
Figure 22:
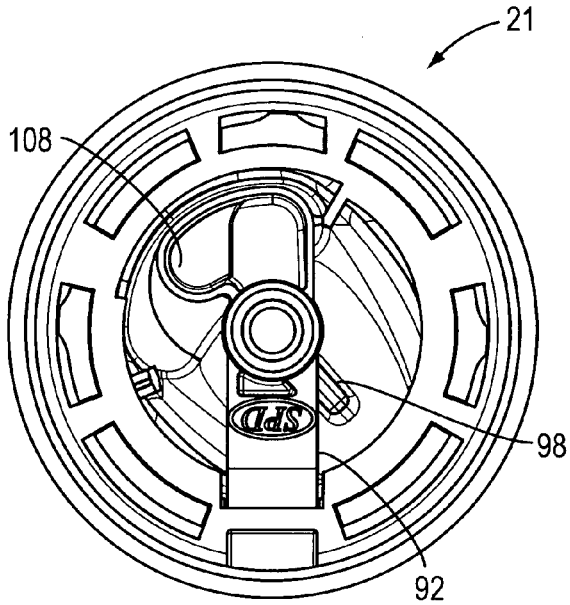
FIG. 22 is a bottom view of the dispenser taken generally along the plane 22-22 in FIG. 21.
Figure 23:
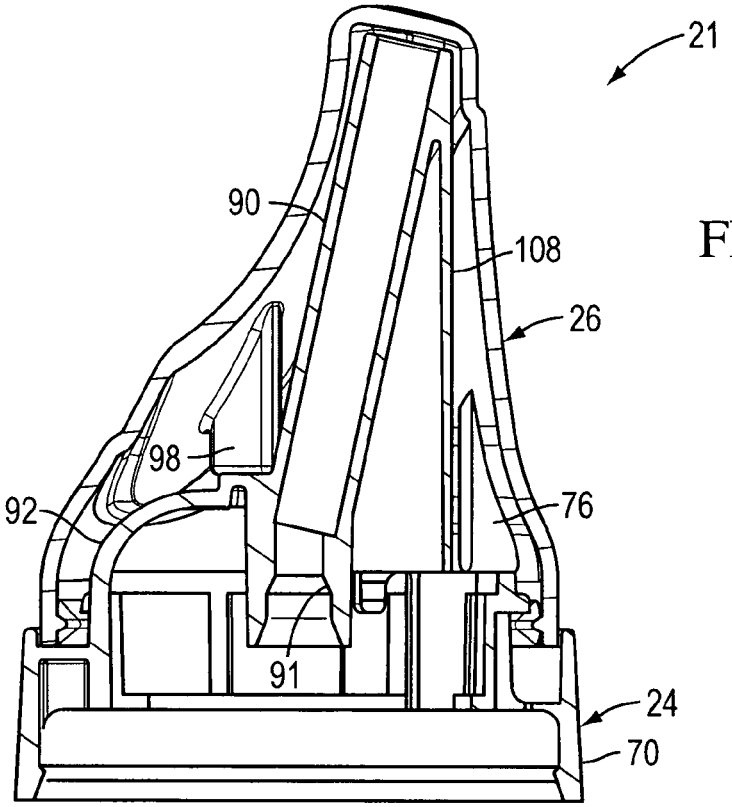
FIG. 23 is a cross-sectional view taken generally along the plane 23-23 in FIG. 22.
Figure 24:
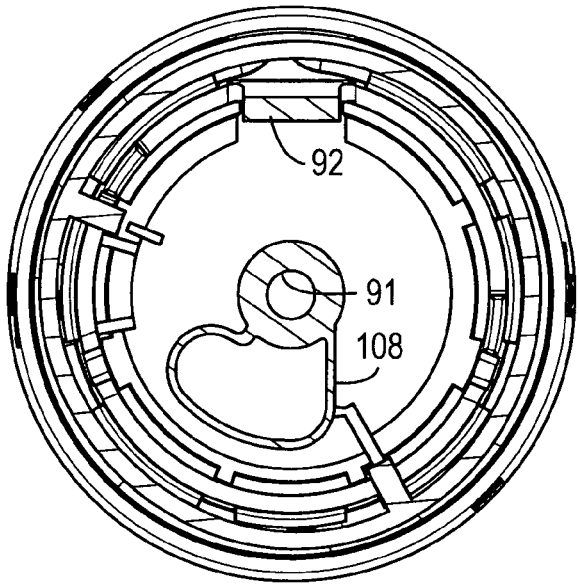
FIG. 24 is a cross-sectional view taken generally along the plane 24-24 in FIG. 21.
Figure 25:
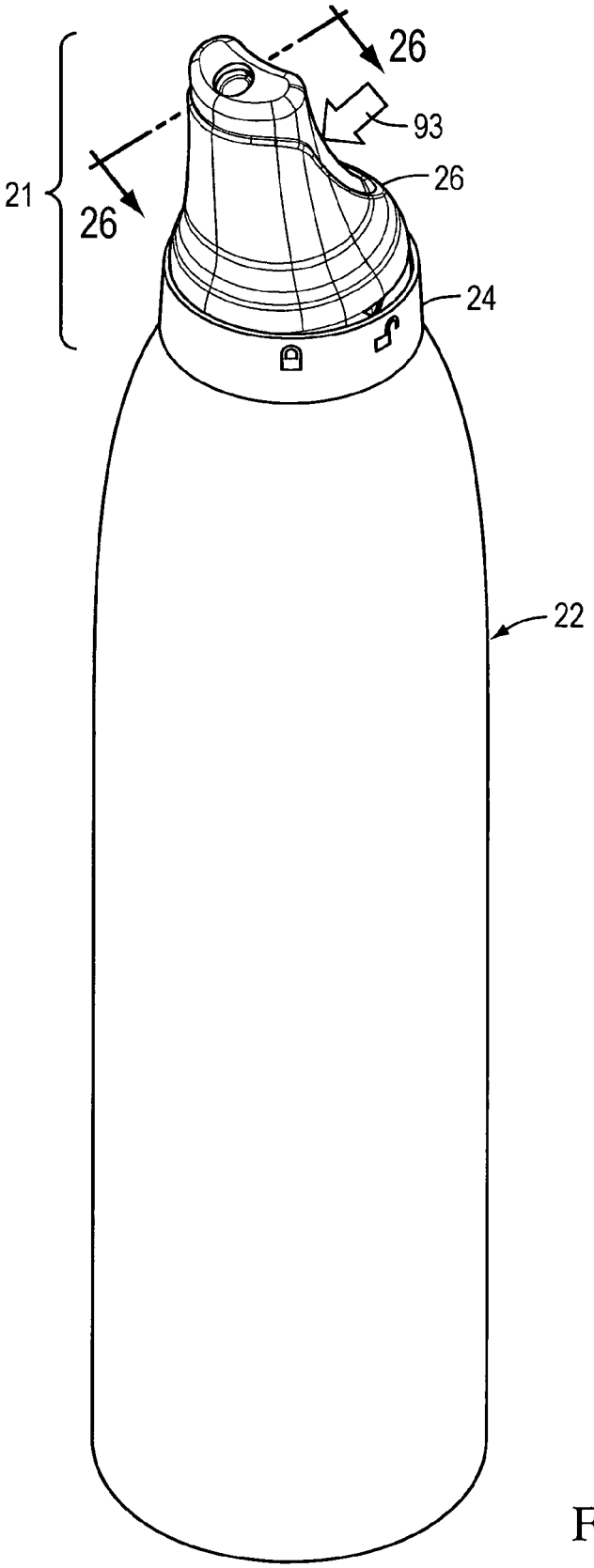

Notably, a preferred form of the abutment surface 100 of connector element 92 is shown in FIG. 7, wherein it will be observed that the abutment surface 100 has an angled edge portion to define a clearance region on top of the connector element 92. The configuration is such that in the first, locked position of the actuator 26 with respect to the base 24, the projecting arm 98 is not positioned above the abutment surface 100, i.e., the projecting arm 98 is positioned to the side of the abutment surface 100 above the clearance region. This facilitates secure transport and storage of the present package, in that in the event of inadvertent downwardly movement of the actuator 26 with respect to the base 24 (notwithstanding the locking components to be described), such downward movement would not cause actuation member 98 to bear against the abutment surface 100, which could undesirably result in inadvertent deflection of nozzle 90, and dispensing of pressurized product from the associated container.

In this embodiment, generally downward pivotal movement of actuator 26 with respect to base 24 is accommodated by the provision of support surface 102 (FIGS. 2 and 7A) defined by the base 24. The support surface 102 acts as a pivotal support for the actuator 26 during its generally downwardly, actuating movement with respect to the base 24.

In order to provide selective downward movement of the actuator 26 with respect to base 24 in its second, dispensing position, one of the actuator 26 and the base 24 defines an abutment surface, and the other of the actuator and the base defines a locking element, so that in the first rotated position of the actuator 26, the locking element engages the abutment surface, and so that in the second rotated position of the actuator, the locking element does not engage the abutment surface, thereby permitting generally downward movement of the actuator relative to the base to move the valve stem 56 to its open, dispensing position. In the first illustrated embodiment, mounting ring 71 of base 24 defines the desired abutment surface at generally along the upper edge of mounting ring 71 with the locking elements 76 (FIGS. 17 and 18) of actuator 26 engaging the abutment surface in the first locked position of the actuator. As will be observed in FIG. 7A, mounting ring 71 defines a pair of gaps 103, generally adjacent the abutment surface thereof, into which the locking elements 76 are respectively movable (see FIG. 26) when the actuator 26 is in a second, dispensing position, as the actuator 26 is moved generally downwardly pivotably about the support surface 102.

As noted, downward movement of actuator 26 with respect to base 24 effects tilting or deflection of nozzle 90, whereby pressurized product flows from container 22 to the nozzle for product dispensing. To this end, actuator 26 defines a discharge opening 104 (FIGS. 1A, 2, and 3) in a distal portion thereof, with the discharge opening 104 generally aligned with the product discharge orifice 106 (FIG. 2) of nozzle 90 in the second, dispensing position of the actuator 26. As will be appreciated, in the second, dispensing position of the actuator 26 (FIG. 26), the nozzle 90 moves generally pivotally with the actuator, whereby the discharge opening 104 and discharge orifice 106 move together and remain generally in alignment with each other.

As will be appreciated, in this illustrated preferred, first embodiment, nozzle 90 is generally vertically oriented, but is arranged at a small angular displacement from a vertical axis extending through the valve assembly 28 (see FIG. 2). As such, rotational movement of actuator 26, relative to base 24, generally about the vertical axis of the package between the first and second rotated positions of the actuator 26, results in the discharge opening 104 of the actuator 26 moving into, and out of, alignment with the discharge orifice 106 of the nozzle 90. Again, when the actuator is in its second (unlocked) position, the actuator 26 and the nozzle 90 move in unison (i.e., deflect or tilt) for opening the valve 30 and dispensing product through nozzle 90.

In the preferred embodiment, in order to generally close and block the discharge opening 104 of the actuator 26 when it is not aligned with the orifice 106 of the nozzle 90, the nozzle 90 includes a shield element (member or door) 108 (FIGS. 1A and 7-10). In this illustrated embodiment, the shield member 108 has a generally tubular or hollow configuration, and extends substantially along the length of the nozzle 90. The uppermost portion of the shield member 108 tends to block or close the discharge opening 104 of the actuator 26 by disposition of the shield member just inwardly of the discharge opening when the actuator 26 is in the unlocked position. The shield member desirably closes off the discharge opening 104 to promote cleanliness, and desirably acts to prevent any dispensed product from moving through the discharge opening in the closed position of the actuator 26, such as foamed mousse product, or the like. In conjunction with the position-indicating features of the present dispenser, consumers can readily discern that the actuator 26 is in its non-dispensing position when the shield member 108 is positioned inwardly of discharge opening 104 to generally close and block the opening.

As shown in FIG. 1, the preferred embodiments of the actuator 26 and base 24 preferably include indicia 82, such as the "locked" padlock symbol and "unlocked" padlock symbol on the base 24, and the triangular arrow head symbol 80 on the actuator 26 to indicate to the user that the user can rotate the actuator 26 between the unlocked condition and the locked, non-actuatable condition by rotating the actuator 26 (either clockwise or counter-clockwise as appropriate) so as to align the arrow head symbol on the actuator 26 with the appropriate symbol on the base 24.

With reference now to FIGS. 36-42, there is illustrated a further (i.e., second) embodiment of the present dispenser and container package. In many respects, this embodiment is like the previously-described embodiment, in that the actuator of the dispenser is generally downwardly pivotably movable with respect to the associated base of the dispenser. In distinction, the previous embodiment is configured such that generally sideways or lateral movement with respect to the actuator effects pivotal movement thereof, generally in a direction away from a user. In contrast, this embodiment is configured such that pivotal movement of the actuator is effected by a user pressing generally downwardly on the actuator, so that the actuator pivots in a direction generally rearwardly toward the user.

In this second embodiment illustrated in FIGS. 36-42, elements that are functionally the same as elements in the first embodiment illustrated in FIGS. 1-35 are designated by like reference numbers in the A-series (i.e., the numbers are followed by the letter "A").

Figure 38:
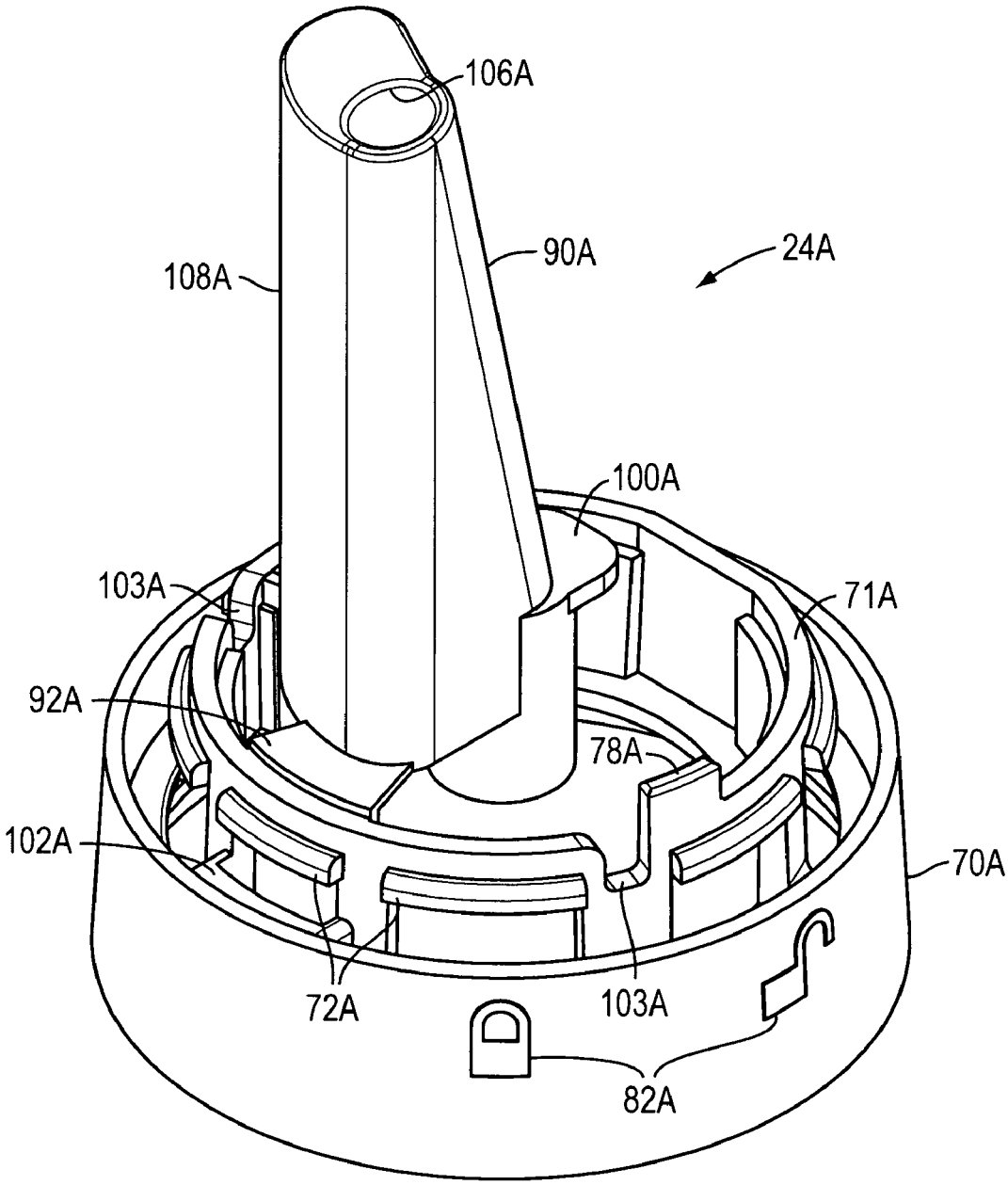
FIG. 38 is an isometric view of the base component or "base" of the second embodiment of the dispenser of the present invention viewed at an angle from the right side above the top and prior to assembly with the other components.
Figure 38A:
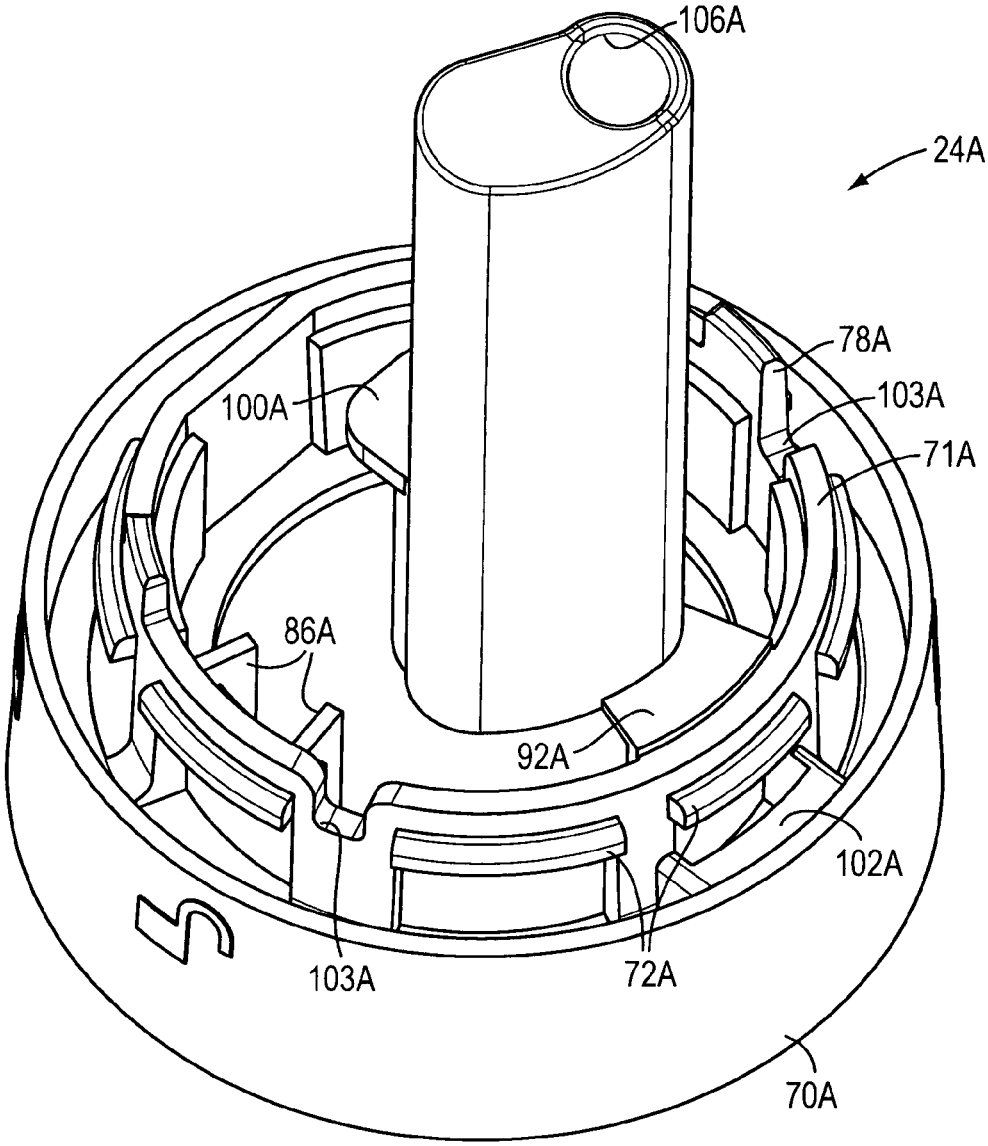
FIG. 38A is an isometric view similar to FIG. 38, but in FIG. 38A the base is viewed from a point on the upper left side of the base.
Figure 39:
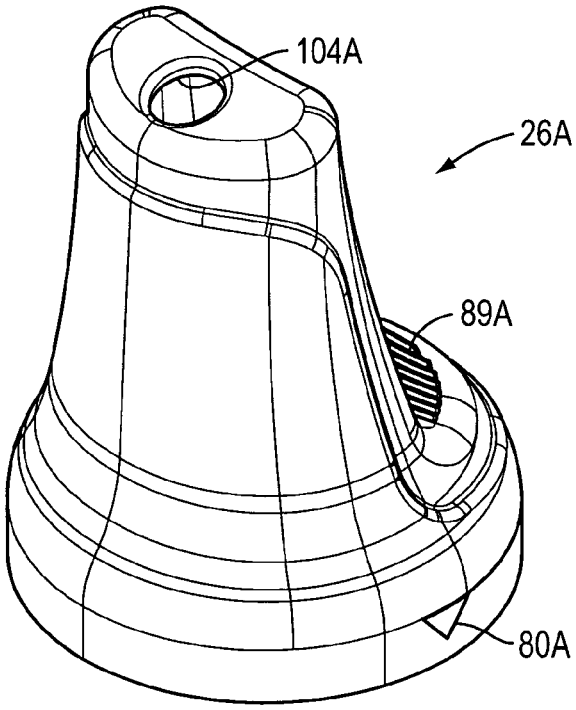
FIG. 39 is an isometric view of the actuator component or "actuator" of the second embodiment of the dispenser as viewed at an angle from above the top, discharge end and prior to assembly with the other components.
Figure 40:
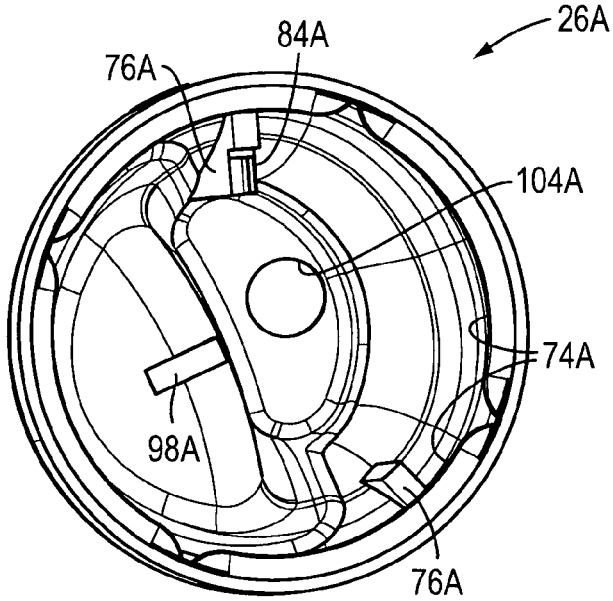
FIG. 40 is a bottom view of the actuator illustrated in FIG. 39.
Figure 41:
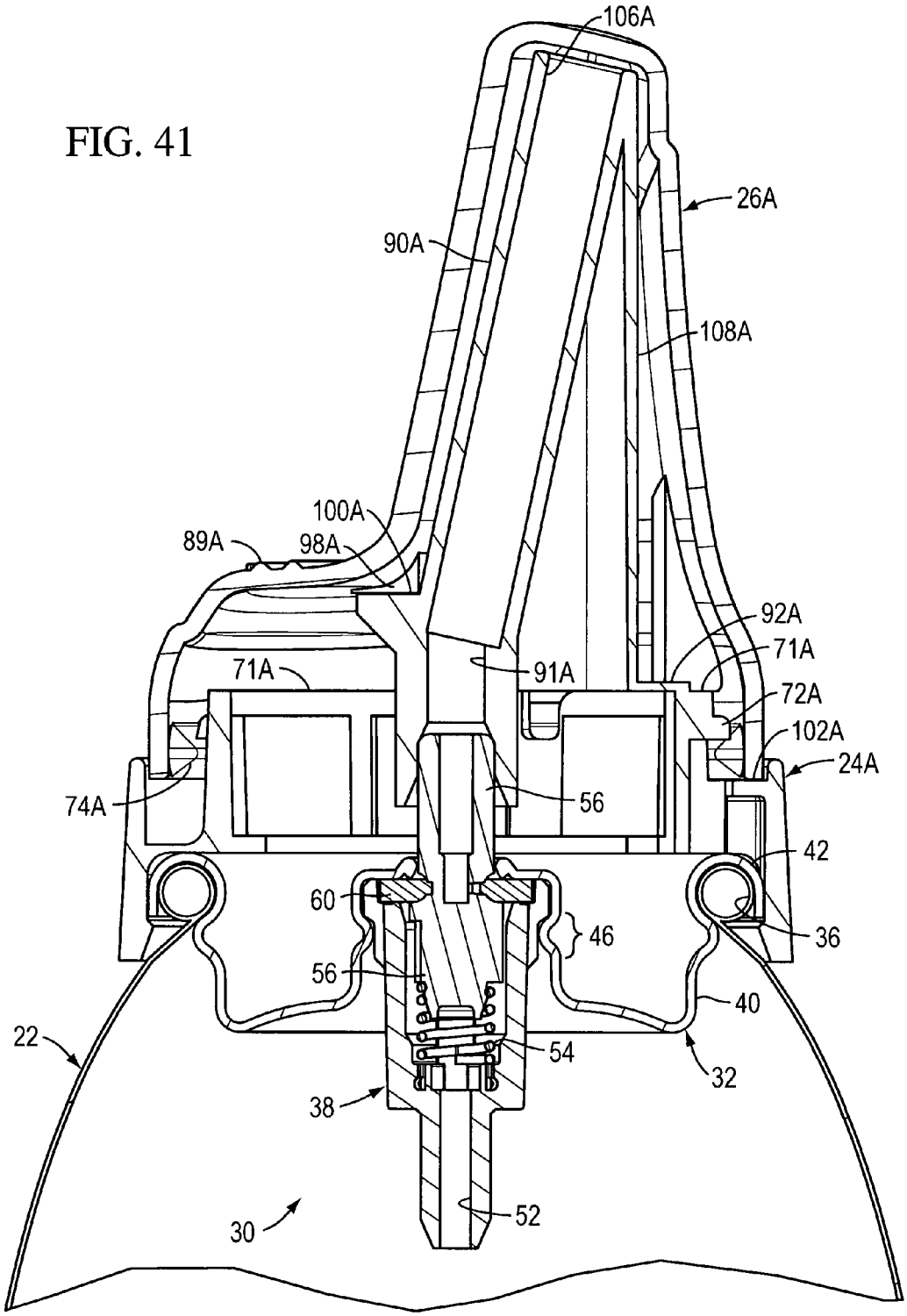
FIG. 41 is a cross-sectional view similar to FIG. 37, but FIG. 41 shows the dispenser in the unactuated, but locked condition wherein the actuator has been rotated (compared to FIG. 37) about 45 degrees relative to the base which remains fixed on the container.

In this embodiment, a dispenser 21A is provided on a container 22, with the dispenser including a base 24A and an actuator 26A operatively connected with a valve assembly 28 provided on the associated container. Features of the valve assembly 28 and the container 22 correspond to those of the previous embodiment, and are designated by like reference numerals. Base 24A (FIGS. 38 and 38A) includes a generally upstanding, annular mounting ring 71A, with the base further including an annular collar 70A by which the base is mounted on the associated container 22. A snap-fit between the actuator 26A and the base 24A is effected by the provision of a plurality of circumferentially spaced snap-fit elements 72A on the base, and a plurality of snap-fit elements 74A on the actuator 26A. By this arrangement, the actuator is secured on the base for limited, relative rotation with respect thereto.

Locking elements 76A (FIG. 40) on the actuator 26A cooperate with stop surfaces 78A on the mounting ring 71A to define and limit the range of rotational movement of the actuator with respect to the base. Position indicating indicia 80A on the actuator 26A, and position-indicating indicia 82A on the base provide a convenient indication for consumers of the position of the actuator relative to the base. As in the previous embodiment, the actuator preferably includes a position-indicating projection 84A (FIG. 40) which cooperatively engages a pair of deflectors 86A (FIG. 38A) to provide the desired tactile and/or audible indication of the rotational position of the actuator with respect to the base. As in the previous embodiment, the illustrated arrangement provides a "double click" as the actuator 26A is moved between its first and second rotated positions with respect to the base 24A.

The base 24A includes a generally elongated nozzle 90A (FIG. 38) which is mounted for generally pivotal, deflecting movement with respect to the mounting ring 71A by a hinge-like connector element 92A. The nozzle defines a stem pocket 91A (FIG. 41) for receiving the stem 56 of the associated valve assembly, whereby the stem 56 is joined in fluid communication with the interior of the nozzle 90A.

In this embodiment, cooperative engagement of the actuator 26A with the base 24A for effecting deflection of the nozzle 90A, and product dispensing is provided by an actuation element 98A (FIGS. 38, 40, and 41) at the interior surface of the actuator 26A, which cooperates with an abutment surface 100A of the base 24A. In this embodiment, the abutment surface 100A projects generally laterally from nozzle 90A, but is positioned generally on the opposite side of the nozzle 90A from the flexible connector element 92A.

Figure 42:
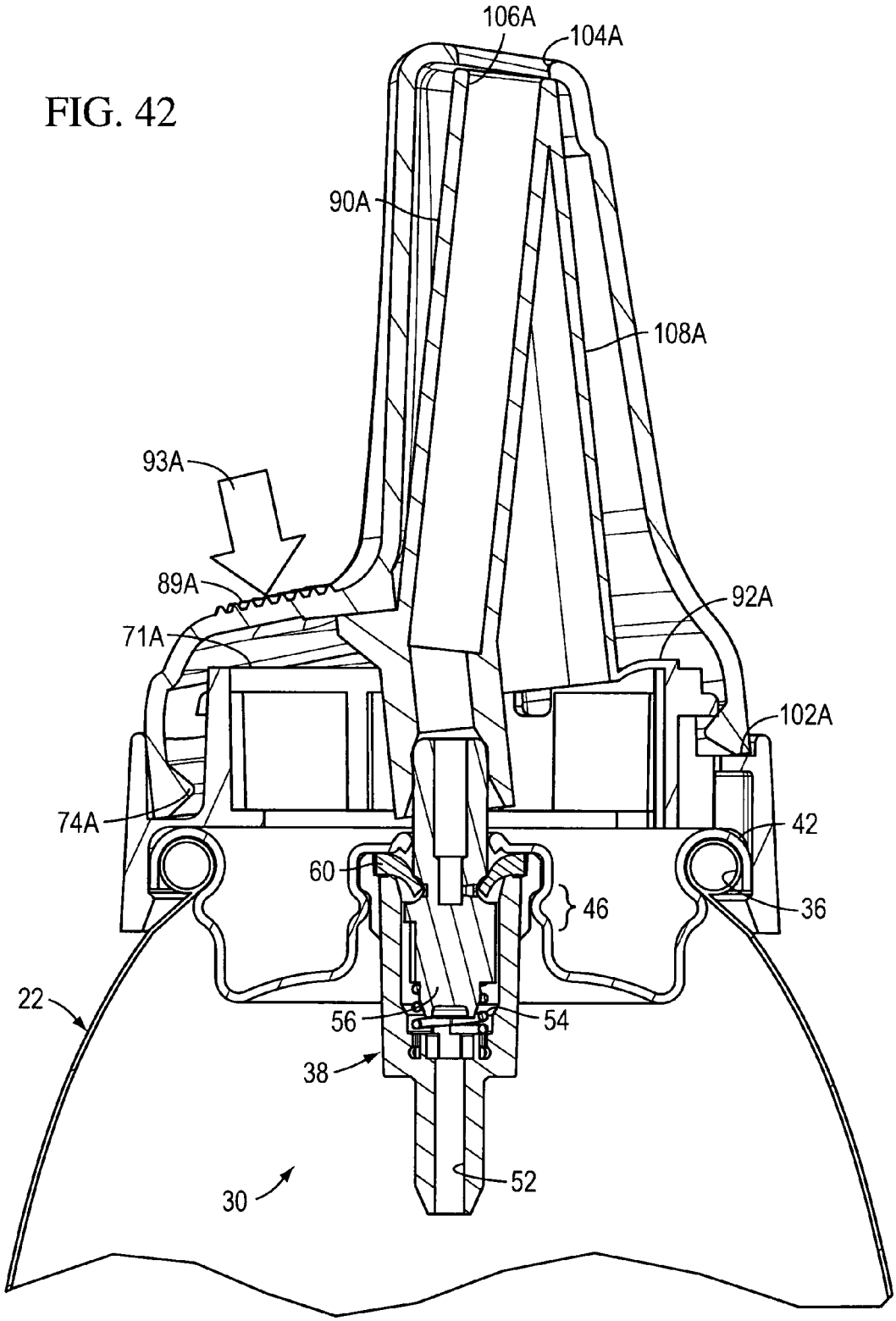
Figure 43:
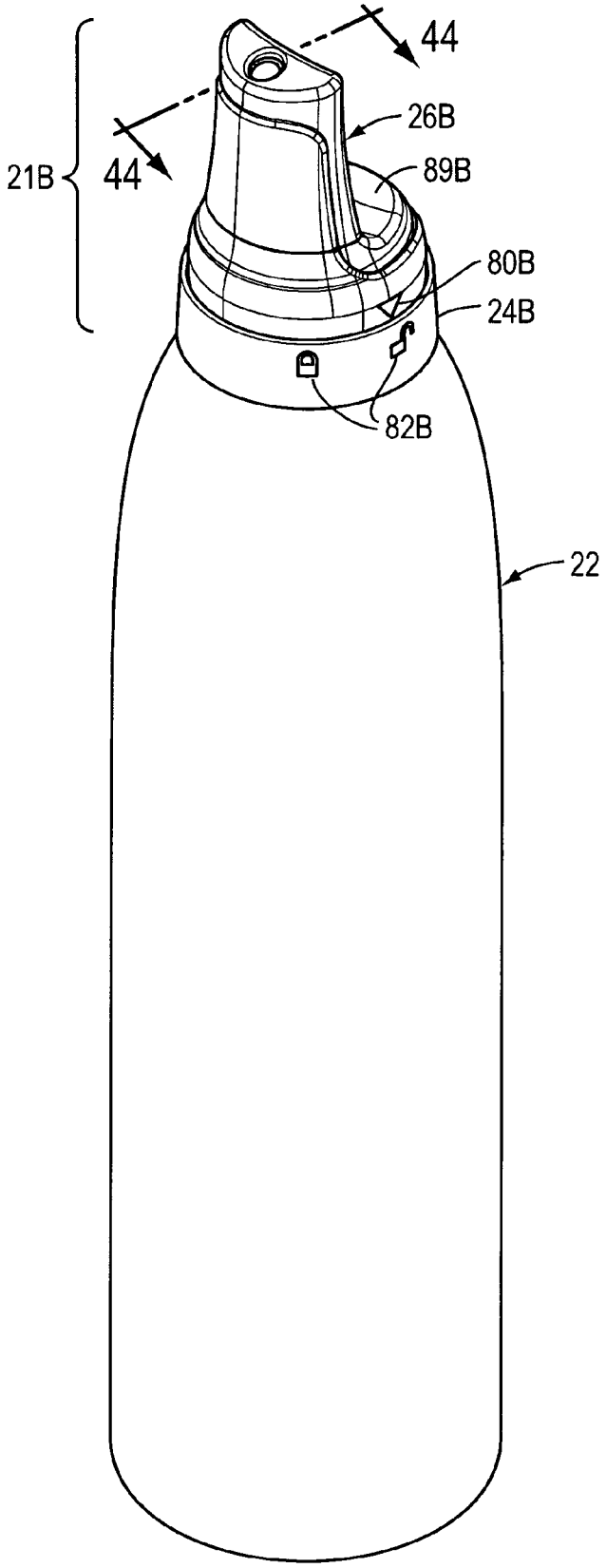
FIG. 43 is an isometric view of a hand-held, finger-operable dispensing package incorporating a dispensing system that includes a valve assembly (not visible) together with a third embodiment of the dispenser of the present invention installed on a container of pressurized product, and the package is shown in FIG. 43 with the dispenser actuator in an unactuated and unlocked condition prior to use.

Support of the actuator 26A for pivotal, dispensing movement of the actuator relative to the base 24A is accommodated by the provision of support surface 102A (FIGS. 37, 38, and 41) which is engaged by the lower periphery of the actuator, generally opposite from a finger pad or actuation region 89A (FIGS. 36, 37, 39, 41, and 42). The user can push with a finger against the pad 89A to apply an actuation force as indicated by the arrow 93A in FIG. 42. As in the previous embodiment, the mounting ring 71A of the base 24A provides an abutment surface generally at its upper edge which is engaged by locking elements 76A (FIG. 40) on the actuator 26A when the actuator is in the first locked position. When the actuator is rotated to the second unlocked position, gaps 103A (FIG. 38A) in the mounting ring 71A accommodate downward movement of the locking elements 76A during downward, actuating pivotal movement of the actuator, as the actuator pivots generally about the support surface 102A (FIG. 42).

A distal portion of the actuator 26A defines a discharge opening 104A (FIGS. 37 and 42), with the nozzle 90A of base 24A defining a discharge orifice 106A with which the discharge opening 104A can be aligned when the actuator is in its second, dispensing position. A shield member 108A, provided in a generally tubular form, extends generally along the length of the nozzle 90A, and acts to close or block the discharge opening in the actuator when the actuator is in its first, non-dispensing rotated position. In the second, unlocked position of the actuator 26A, the nozzle 90A can move with the actuator as the actuator is depressed, with the discharge orifice 106A of the nozzle remaining in alignment and moving with the discharge opening 104A of the actuator for product dispensing.

With reference now to FIGS. 43-49, therein is illustrated a further alternate embodiment (i.e., a third embodiment) of the present invention, designated by like reference numerals in the B-series. As previously noted, this embodiment of the present invention functions such that the actuator of the dispenser is generally downwardly movable in a non-pivotal fashion with respect to the associated base, to thereby effect downward movement of the stem 56 of the associated valve assembly.

In this embodiment, components of the valve assembly 28 and the associated container are designated by reference numerals which correspond to those of the previous embodiments.

Figure 44:
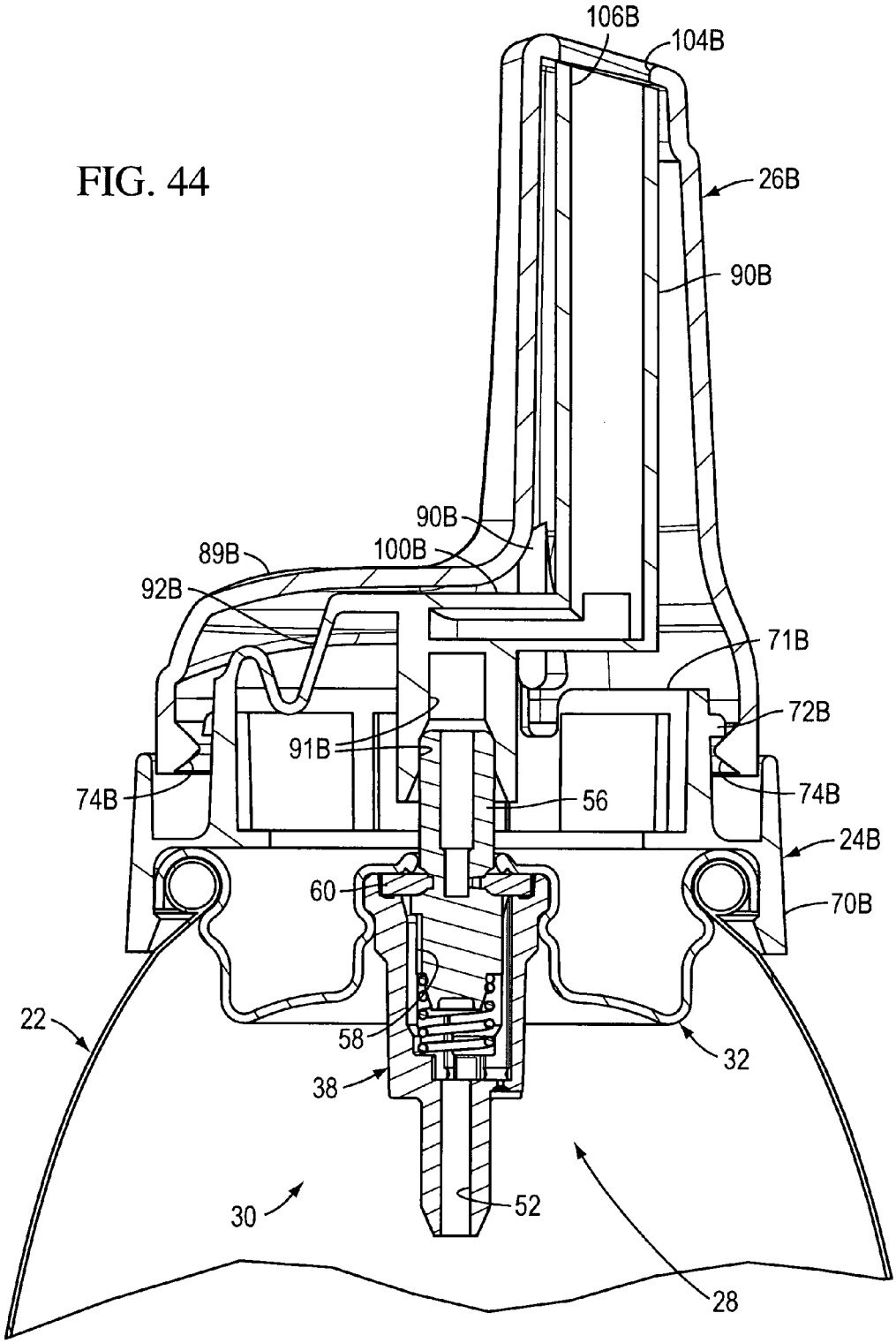
FIG. 44 is a greatly enlarged, fragmentary, cross-sectional view taken generally along the plane 44-44 in FIG. 43.

As can be seen in FIG. 44, dispenser 21B of this embodiment includes an actuator 26B retained on a mounting ring 71B of an associated base 24B by cooperating, inter-engaged snap-fit elements 72B and 74B, respectively provided on the base and actuator of the dispenser. A collar 70B retains the base 24B on the associated container 22.

Figure 49:
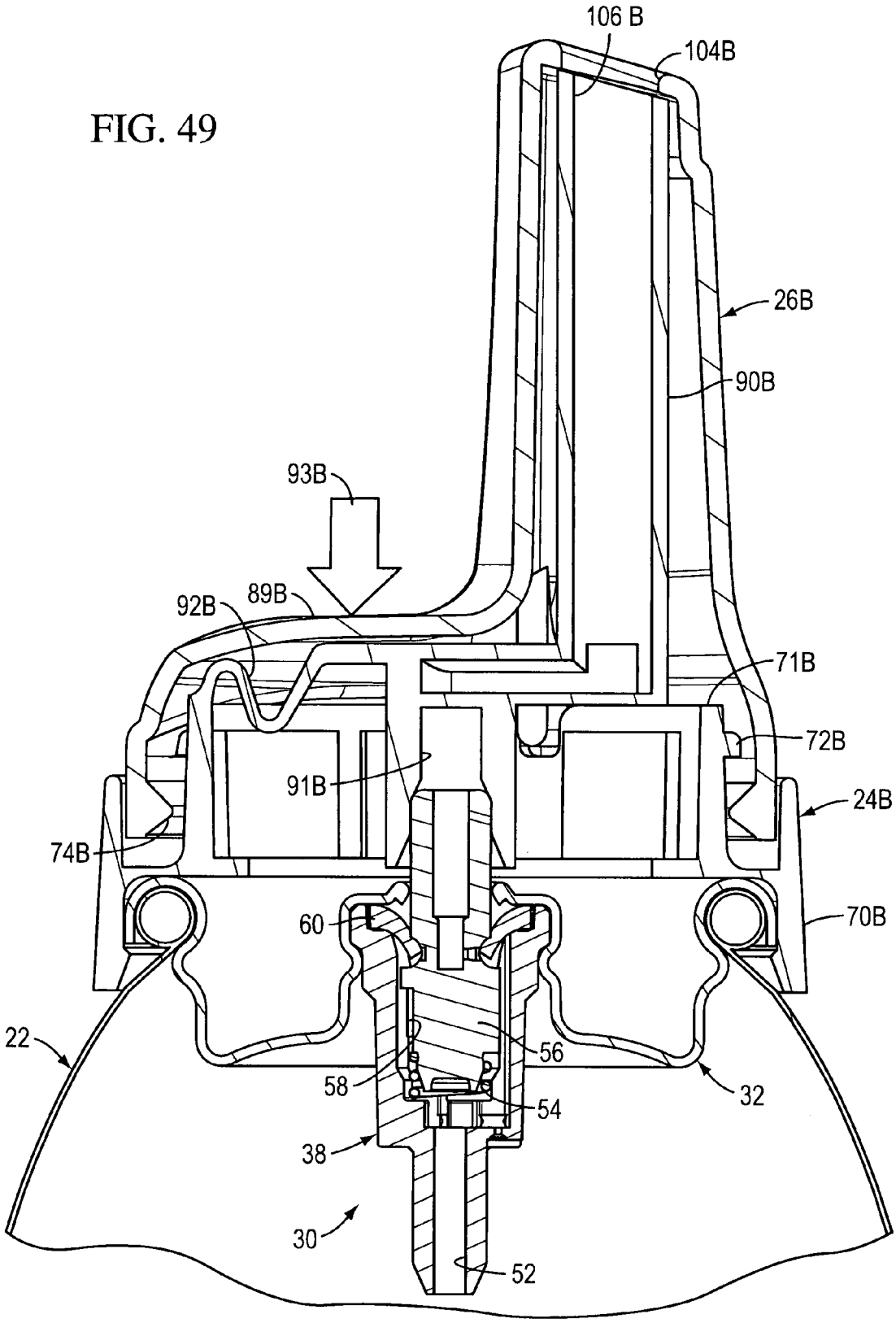
Figure 50:
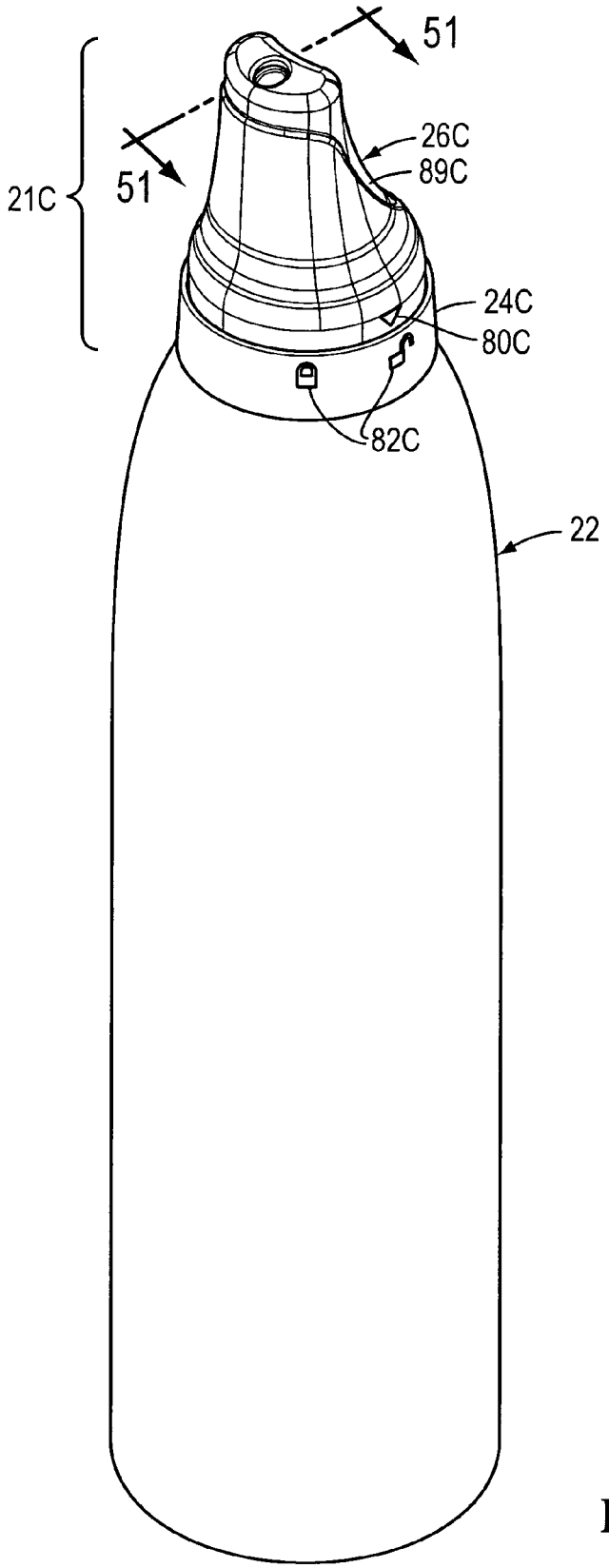
FIG. 50 is an isometric view of a hand-held, finger-operable dispensing package incorporating a dispensing system that includes a valve assembly (not visible) together with a fourth embodiment of the dispenser of the present invention installed on a container of pressurized product, and the package is shown in FIG. 50 with the dispenser actuator in an unactuated and unlocked condition prior to use.

The actuator 26B is retained on the base 24B for limited relative rotation with respect to the base, and generally downward, non-pivotal movement with respect to the base for effecting actuation of the associated valve 30. A clearance region is defined by the base 24B between the mounting ring 71B and collar 70B thereof, into which a proximal portion of actuator 26B is downwardly moved during actuation of the dispenser in the dispensing position of the actuator (FIG. 49).

Figure 45:
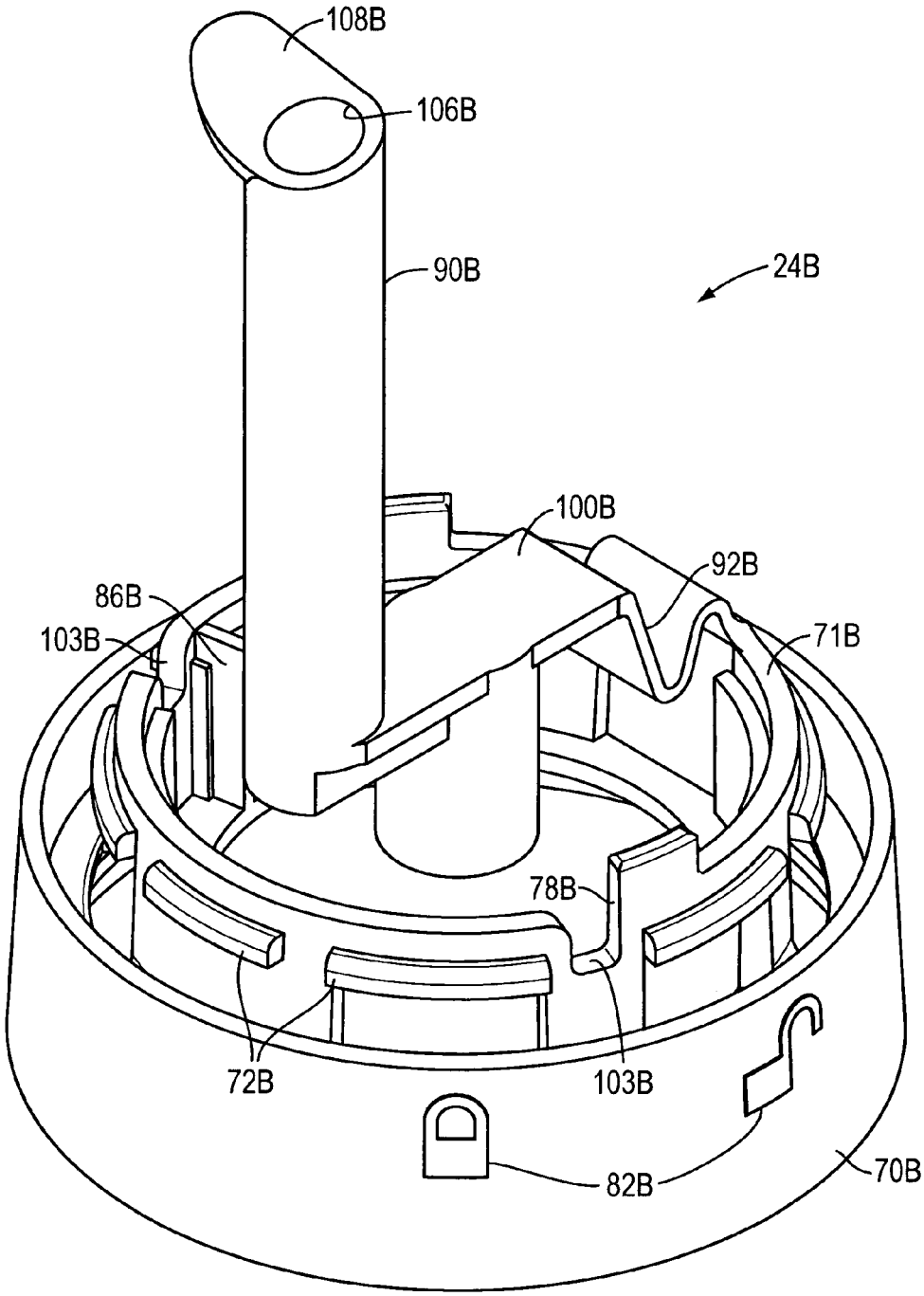
FIG. 45 is an isometric view of the base component or "base" of the third embodiment of the dispenser of the present invention viewed at an angle from the right side above the top and prior to assembly with the other components.
Figure 45A:
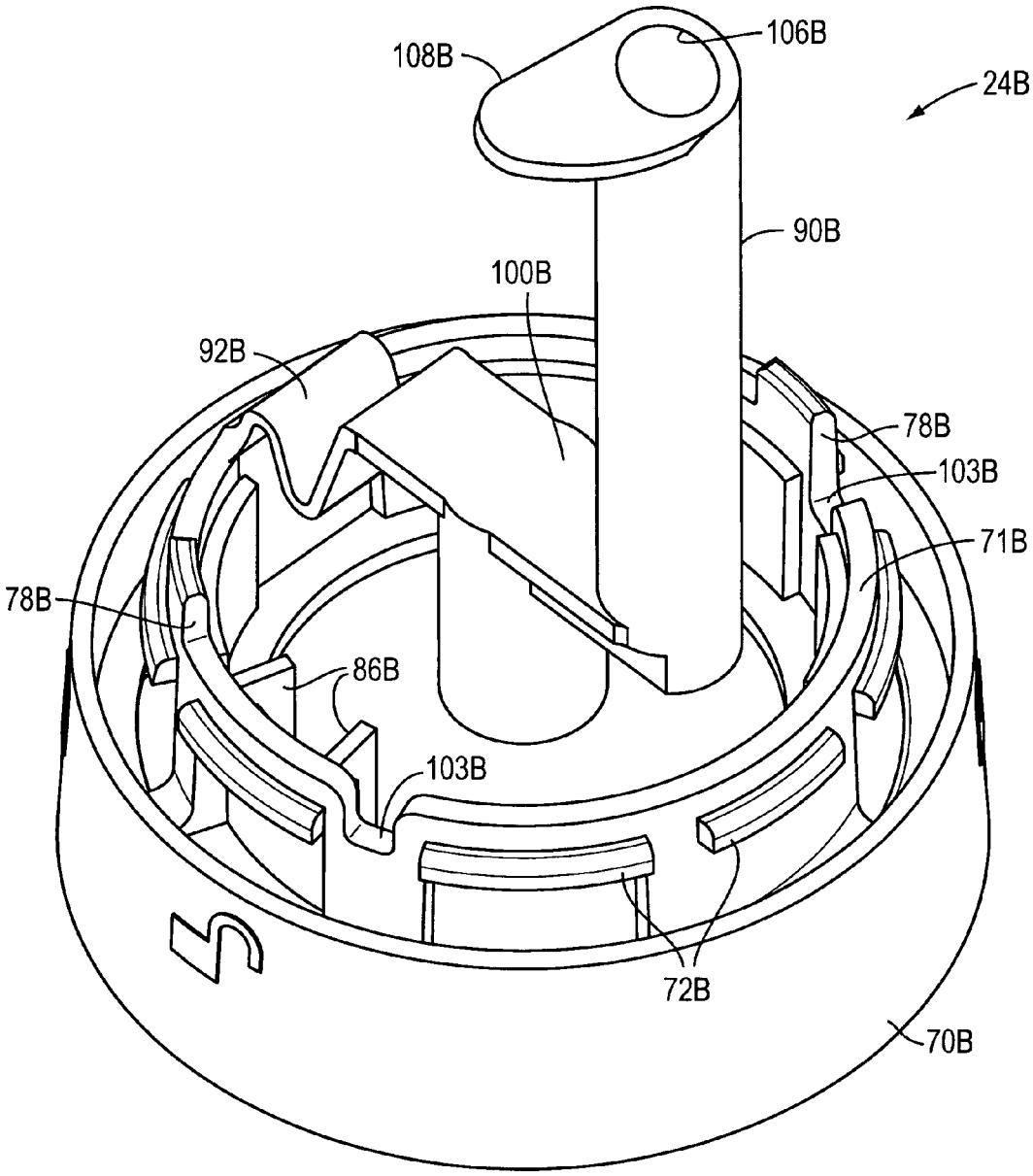
FIG. 45A is an isometric view similar to FIG. 45, but in FIG. 45A the base is viewed from a point on the upper left side of the base.
Figure 46:
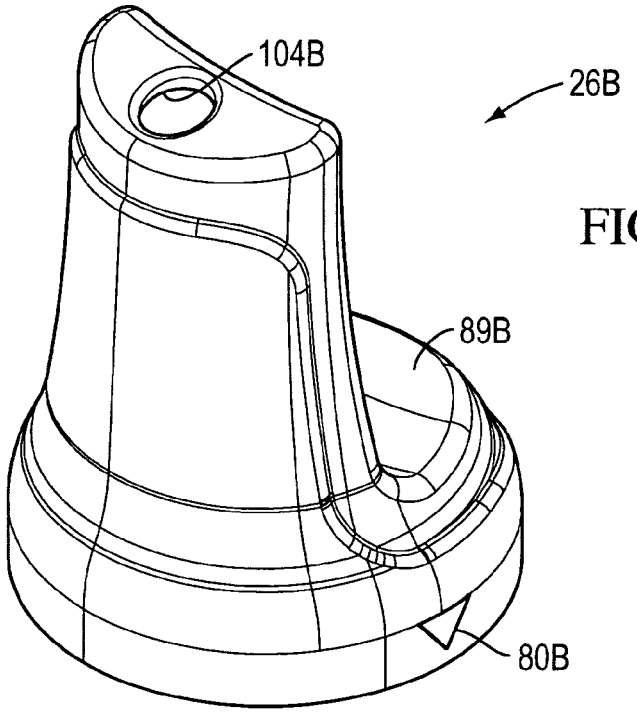
FIG. 46 is an isometric view of the actuator component or "actuator" of the third embodiment of the dispenser as viewed at an angle from above the top, discharge end and prior to assembly with the other components.
Figure 47:
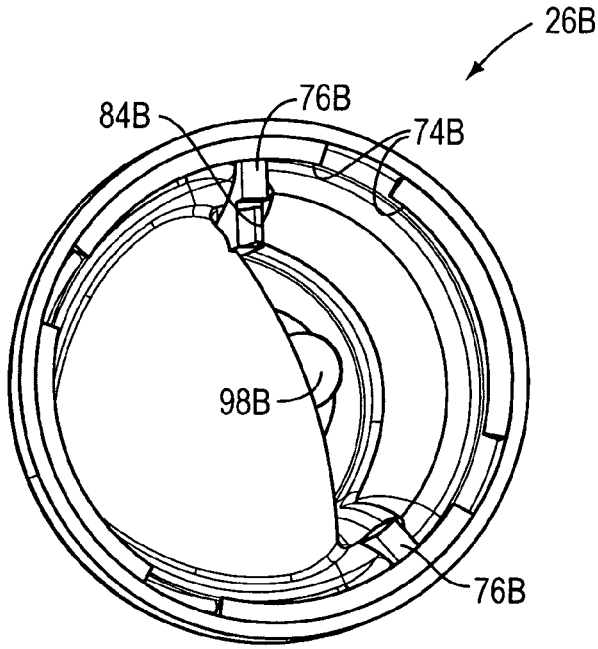
FIG. 47 is a bottom view of the actuator illustrated in FIG. 46.
Figure 48:
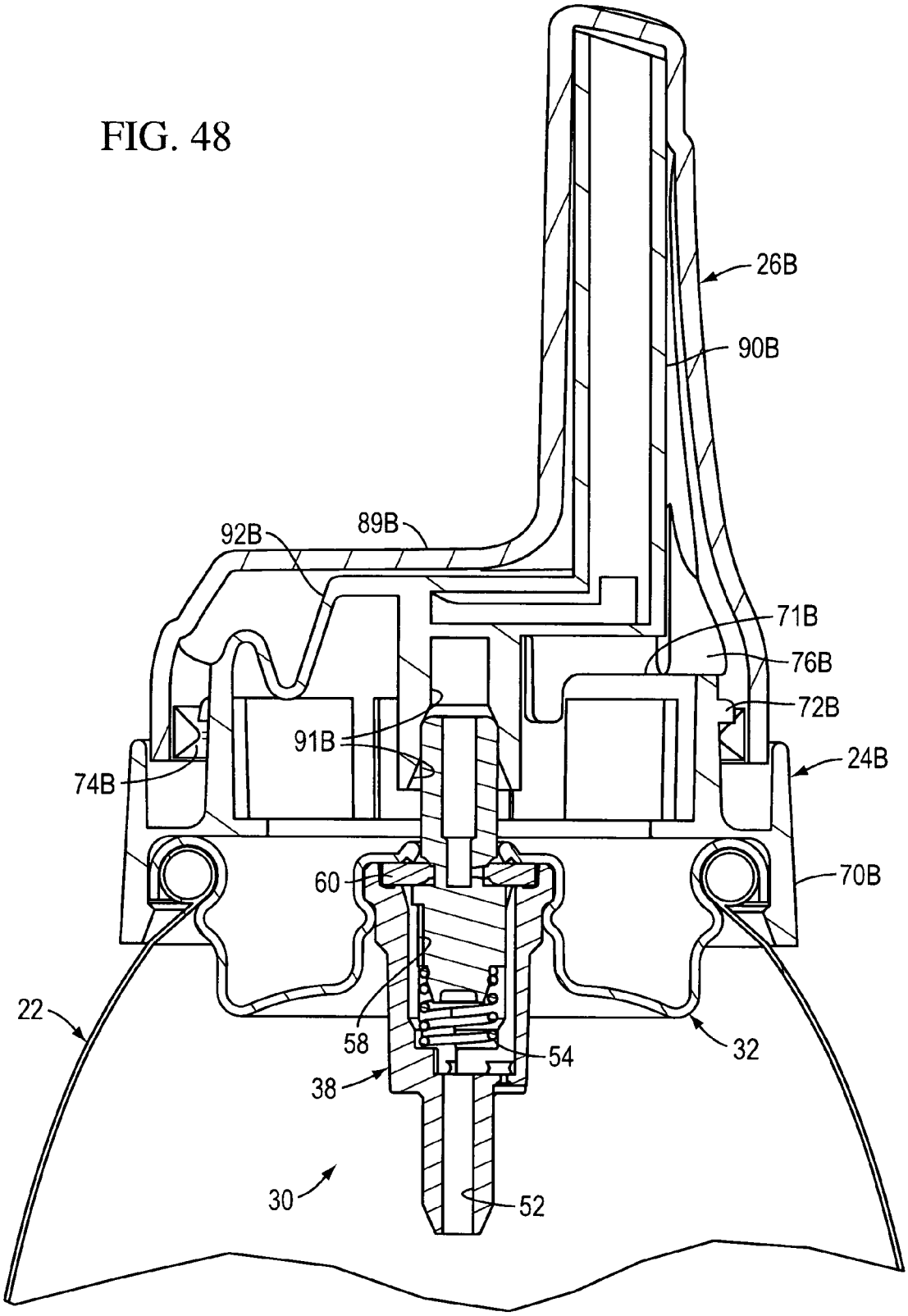
FIG. 48 is a cross-sectional view similar to FIG. 44, but FIG. 48 shows the dispenser in the unactuated, but locked condition wherein the actuator has been rotated (compared to FIG. 44) about 45 degrees relative to the base which remains fixed on the container.

The range of relative rotation of the actuator 26B with respect to the base 24B is defined by cooperation between a pair of locking elements 76B (FIG. 47) on the actuator, which respectively engage a pair of stop surfaces 78B (FIG. 45A) provided on the mounting ring 71B of the base 24B. The locking elements 76B can be configured in accordance with the previous embodiments, with indicia 80B and 82B (FIG. 43) respectively provided on the actuator and the base, providing users with readily discernible indication of the position of the actuator on the base, so it can be determined if the actuator is in its first rotated, locked position, or in its second rotated, unlocked position wherein the actuator is generally downwardly movable with respect to the base. The provision of an arrangement for audibly and/or tactilely providing users with an indication of the position of the actuator further preferably comprises a pair of deflectors 86B (FIG. 45A) on the base 24B, which cooperate with a position-indicating projection 84B on the actuator 26B (FIG. 47).

In accordance with this illustrated embodiment, the base 24B of the dispenser includes a generally vertically oriented nozzle 90B (FIG. 45) joined in fluid communication with a stem pocket 91B (FIG. 44) within which the stem 56 of the associated valve is positioned when the dispenser is operatively positioned on an associated container. A generally S-shaped or serpentine hinge-like connector element 92B (FIGS. 44 and 45) connects the nozzle 90B to the mounting ring 70B, with this configuration of the connector element desirably facilitating generally vertical movement of the nozzle and stem pocket attendant to actuation of the dispenser by a user vertically depressing a finger pad 89B on the exterior of the actuator 26B as indicated by the arrow 93B in FIG. 49.

To this end, the actuator can include an actuation element 98B for engagement with an abutment surface 100B (FIG. 44) of the base 24B, whereby the actuator is operatively connected with the valve assembly of the associated container.

In order to prevent dispensing movement of the actuator when it is in its first, locked position, the top portion of the mounting ring 71B of the base 24B defines an abutment surface against which locking elements 76B (FIGS. 47 and 48) engage to prevent relative downward movement of the actuator with respect to the base. The mounting ring 71B further defines a pair of gaps 103B (FIG. 45B) within which locking elements 76B are respectively positionable when the actuator 26B is in the second, unlocked position and moved downwardly with respect to the base 24B by user force exerted upon the finger pad or actuator region 89B of the actuator (FIG. 49).

The actuator 26B defines a discharge opening 104B through which product from the nozzle 90B is dispensed. As in the previous embodiments, the nozzle of the base defines a discharge orifice 106B, which is positioned in substantial alignment with the discharge opening 104B of the actuator in the second rotated position of the actuator with respect to the base.

The nozzle 90B preferably includes a generally planar shield member 108B (FIG. 45A) which extends generally laterally from the nozzle, and is positioned just inwardly of the discharge opening 104B of the actuator when the actuator is in its first, locked closed position. In the second, unlocked position of the actuator 26B, the nozzle 90B can move with the actuator 26B as the actuator 26B is depressed, with the discharge orifice 106B of the nozzle remaining in alignment and moving with the discharge opening 104B of the actuator for product dispensing.

With reference now to FIGS. 50-56, therein is illustrated a further (fourth) embodiment of the present dispenser, with components thereof generally corresponding to those of the previously-described embodiments designated by like reference numerals in the C-series. Components of the associated container which are like those of the previous embodiment are designated by like reference numerals. In this embodiment, the illustrated valve assembly mounted on the associated container is of a so-called tilt/toggle-style, and differs from the valve of the previous embodiments in that actuation is effected by generally sideways or lateral movement of the stem of the valve, as opposed to vertical stem movement as in the previously-described valve assembly.

With particular reference to the valve assembly, components corresponding generally to those of the previously-described valve assembly are designated by like reference numerals in the C-series.

Figure 51:
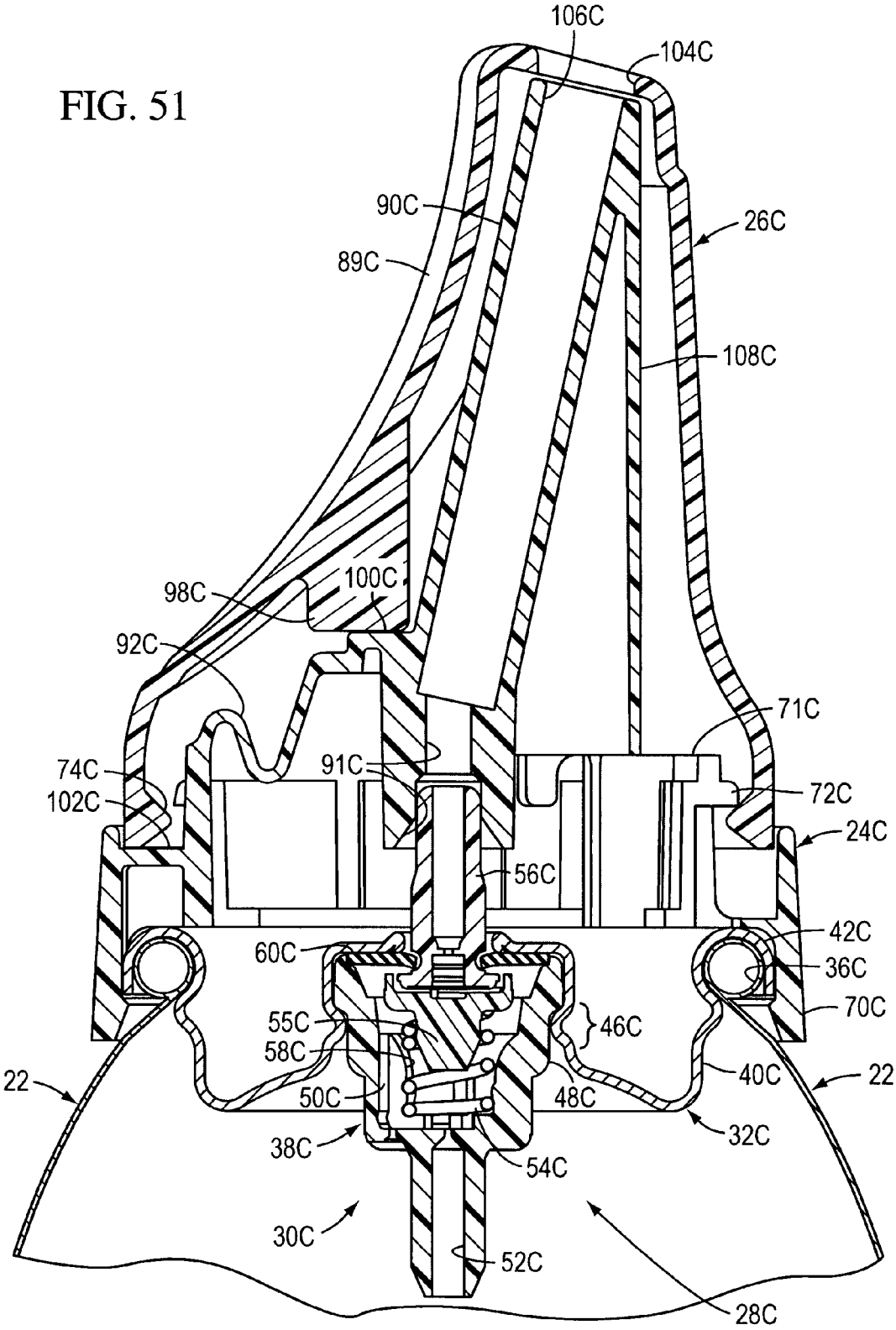
FIG. 51 is a greatly enlarged, fragmentary, cross-sectional view taken generally along the plane 51-51 in FIG. 50.

Thus, with reference to FIG. 51, the valve assembly 28C of this embodiment includes a valve 30C and a mounting cup 32C fitted on mounting bead 36 of the associated container 22.

The dispensing valve 30C has a body 38C, a part of which typically extends into the opening at the top of container 22.

The valve 30C is mounted in the conventional valve mounting cup 32C which is made of suitable material, and which has a mounting flange 40C with an outer peripheral flange 42C that can be crimped about the container opening bead 36 to provide a secure attachment of the mounting cup 32C to the top of the container 22.

The mounting cup 32C includes an annular inner wall which defines an opening through which a hollow stem 56C of the valve projects. The annular inner wall includes a crimp 46C for engaging exterior portions of castellations or ribs 48C on the exterior of the valve body 38C of the valve 30C.

The body 38C of the valve 30C defines an interior chamber 50C which has a bottom end that is open through a passage 52C in the body 38C to the pressurized contents in the associated container 22. The container 22 typically holds a liquid product (or other fluent substance product), which is pressurized by a propellant gas.

A compression coil spring 54C is disposed in the valve body interior chamber 50C, with a valve seat 55C normally biased upwardly in the chamber 50C by the spring 54C. The valve seat 55C is urged against valve stem 56C in sealing cooperation therewith when the valve is in its unactuated disposition, wherein the stem 56C extends vertically upwardly.

The valve body 38C includes vertical ribs 58C in the chamber 50C defining flow passages between them which extend from the bottom portion of the chamber 50C to the upper portion of the chamber 50C, which is covered by gasket 60C retained by the mounting cup 32C at the top of the valve body 30C. The radial, outer periphery of the gasket 60C is clamped between the upper end of the valve body 38C, and the top, inner, annular edge of the mounting cup 32C.

Figure 56:
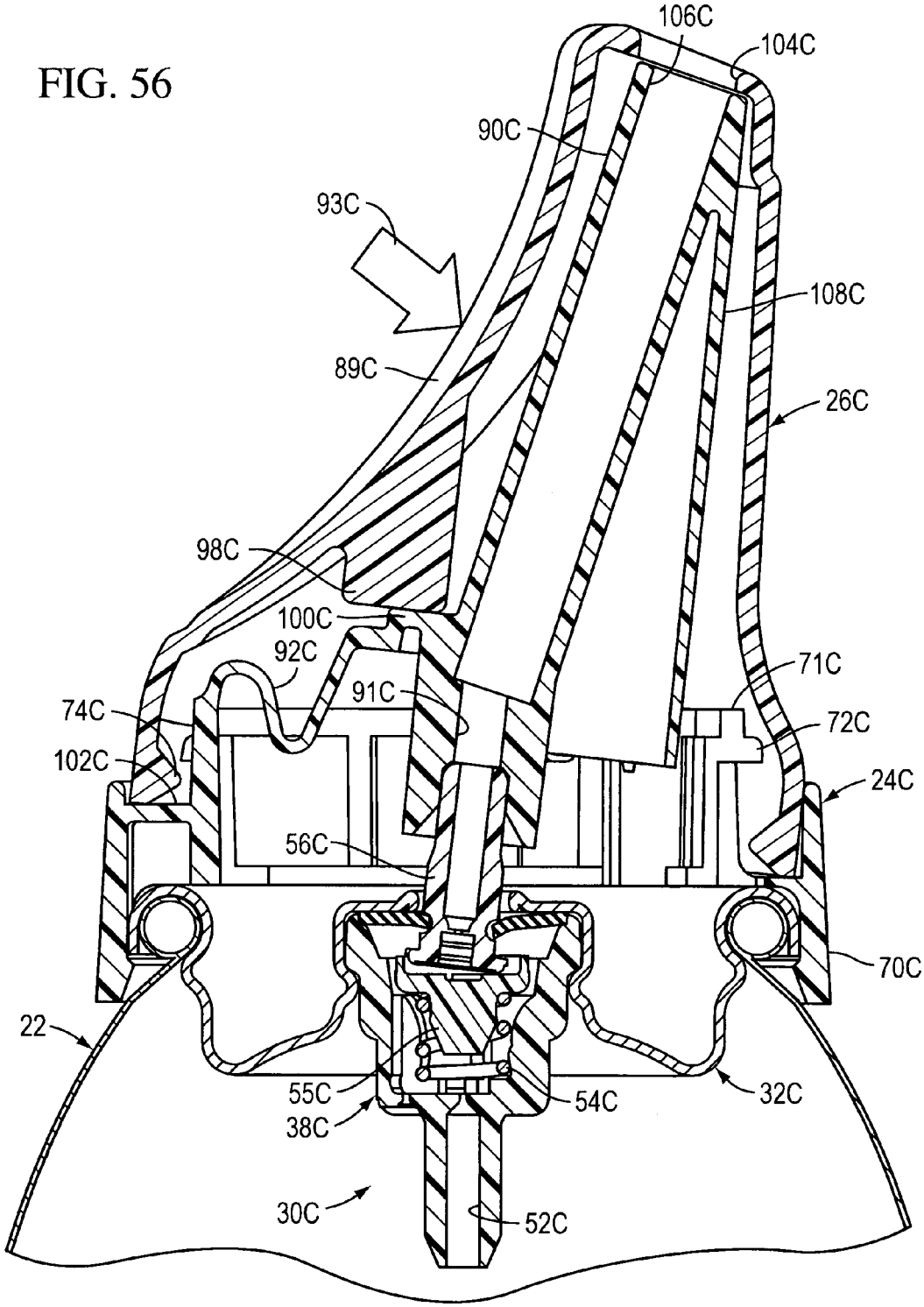

The valve stem 56C defines an annular groove for receiving the inner periphery of the gasket 60C in a seated or sealing relationship when the stem 56C is normally biased to the vertically oriented, unactuated, closed position (FIG. 51). Actuation of the valve 30C is illustrated in FIG. 56, wherein the valve stem 56C is illustrated having been tilted and/or toggled from its vertically oriented, closed disposition. By this movement of the valve stem 56C, the valve stem is unseated from its sealing relationship with the associated valve seat 55C, whereby pressurized, fluent substance product can flow from the interior of the container 22 and through the above-described passages of the valve body 38C. When the valve is actuated in this manner, product flows between the valve seat 55C and tilted valve stem 56C, upwardly through the valve stem, and through the dispenser of the present invention, as will now be described.

The dispenser 21C of this embodiment has been particularly configured for cooperative actuation of the tilt/toggle-style valve 30C of this embodiment. As can be seen in FIG. 51, the dispenser includes a base 24C having a mounting ring 71C, and an annular collar 70C by which the dispenser is fitted to the associated container. The dispenser further includes a generally elongated actuator 26C, having proximal portion rotatably, snap-fit to the mounting ring 70C of base 24C, and a distal portion through which product is dispensed. Cooperating, inter-engaging snap-fit elements 72C and 74C are respectively provided on the base and actuator of the dispenser for providing the desired rotatable snap-fit between these components of the dispenser.

Figure 52:
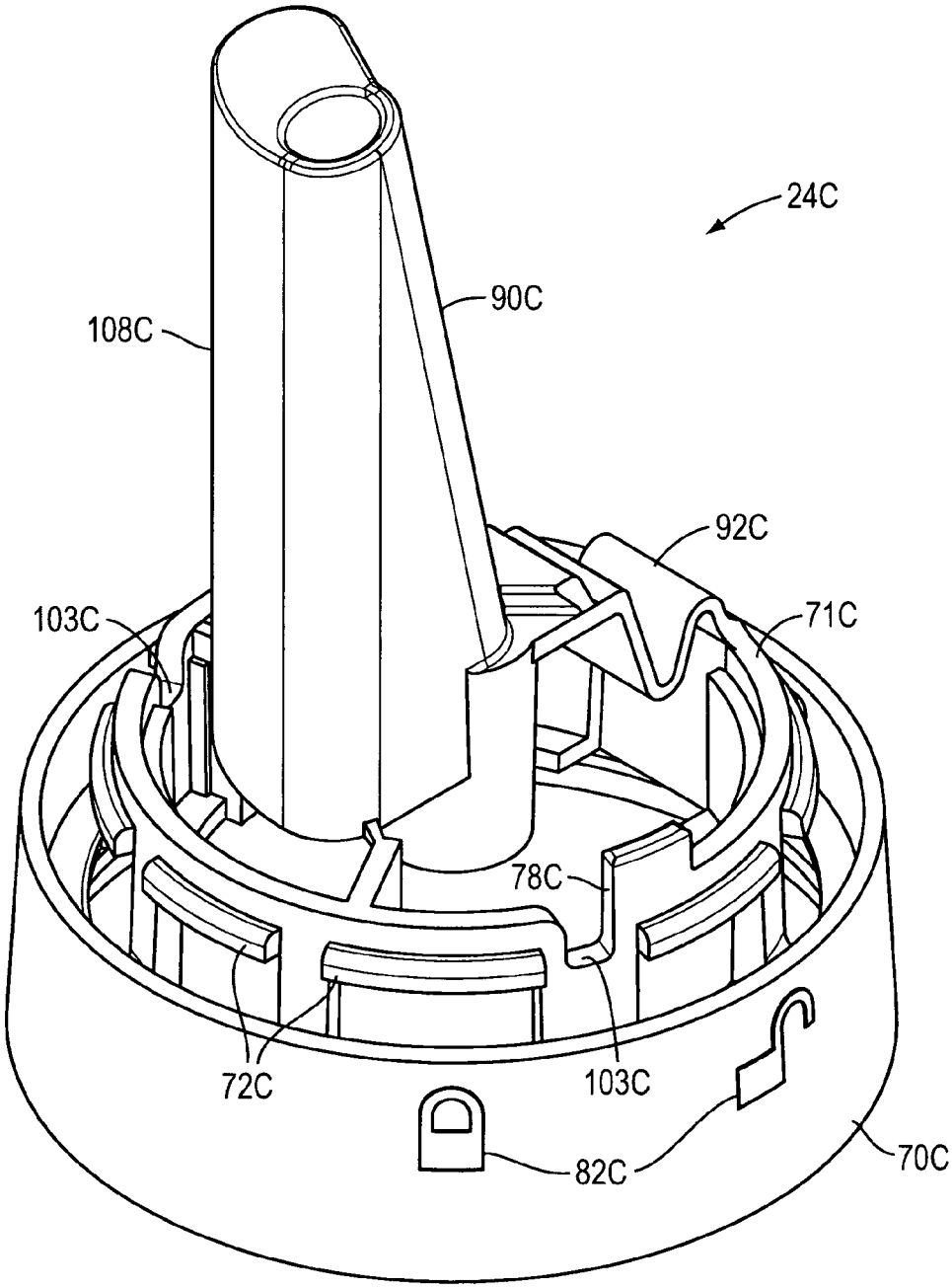
FIG. 52 is an isometric view of the base component or "base" of the fourth embodiment of the dispenser of the present invention viewed at an angle from the right side above the top and prior to assembly with the other components.
Figure 52A:
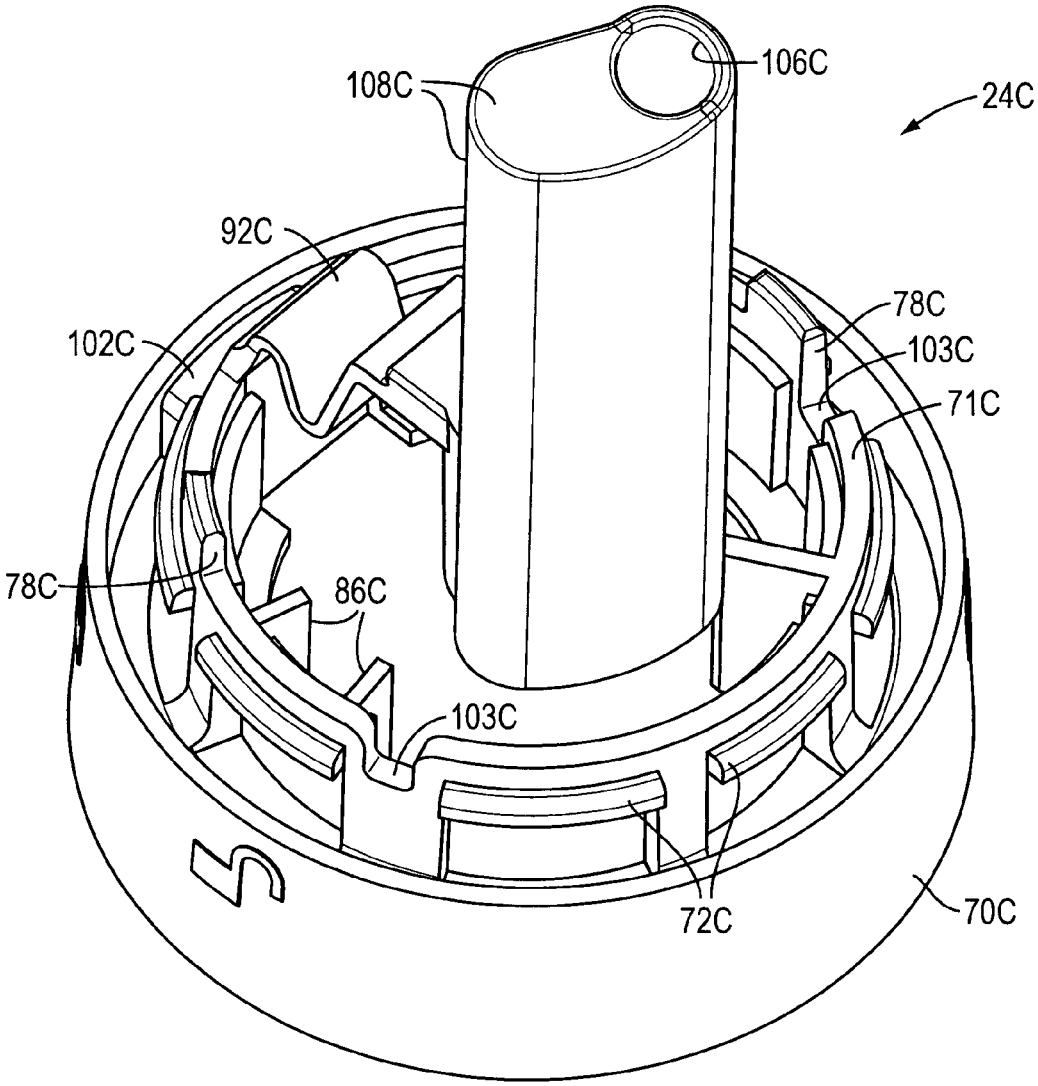
FIG. 52A is an isometric view similar to FIG. 52, but in FIG. 52A the base is viewed from a point on the upper left side of the base.
Figure 53:
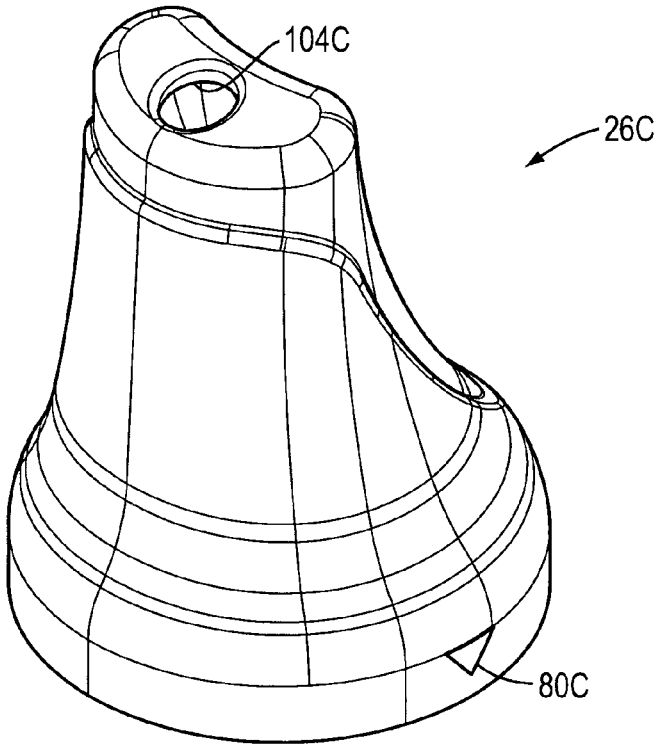
FIG. 53 is an isometric view of the actuator component or "actuator" of the fourth embodiment of the dispenser as viewed at an angle from above the top, discharge end and prior to assembly with the other components.
Figure 54:
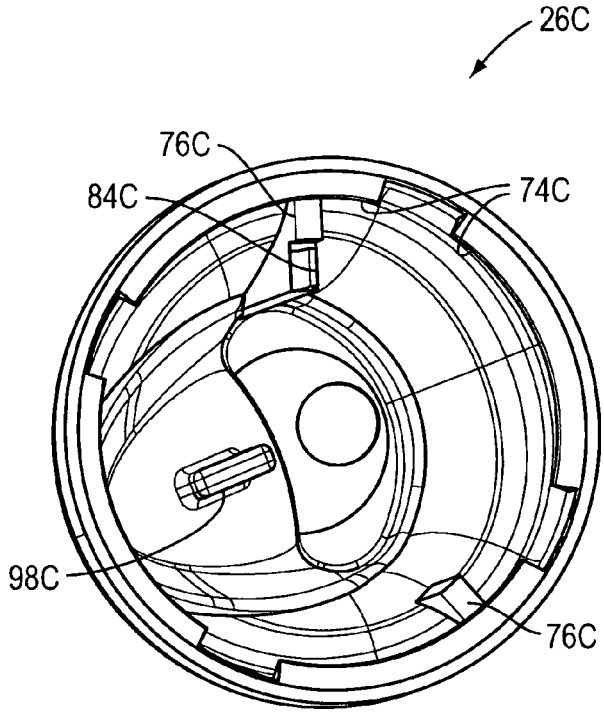
FIG. 54 is a bottom view of the actuator showing interior details.

In order to provide the desired limited rotational movement of the actuator 26C with respect to the base 24C between the first, locked position and the second, unlocked position, the actuator 26C defines a pair of locking elements 76C (FIG. 54) which respectively cooperate with stop surfaces 78C (FIG. 52A) provided on the base 24C. Position indicia 80C and 82C (FIG. 52) are respectively provided on the actuator and the base for providing a readily visually discernible indication of the relative position of the actuator on the base.

The desired audible and/or tactile indication of the actuator position is desirably provided a position-indicating projection 84C (FIG. 54) provided on the actuator 26C, and a pair of position-indicating deflectors 86C (FIG. 52A) provided on base 24C for cooperating engagement with position-indicating projection 84C (FIG. 54) provided on the actuator 26C.

The base 24C includes a generally elongated nozzle 90C which extends generally upwardly from, and is in fluid communication with, a stem pocket 91C (FIG. 51). The nozzle 90C is movably connected with the mounting ring 70C by a generally S-shaped or serpentine hinge-like connector element 92C (FIGS. 51 and 52), which is configured so as to provide the desired deflection of the nozzle, by manipulation of the actuator, to thereby effect the desired tilting/toggling movement of the valve stem 56C of the valve 30C.

Deflecting movement or tilting movement of the nozzle 90C is effected by selective manipulation of the actuator 26C in a generally sideways or lateral fashion, with actuation element 98C (FIGS. 54 and 56) of the actuator cooperating with and engaging an abutment surface 100C (FIG. 56) of the base for operatively connecting the actuator with the nozzle 90C and valve stem 56C. FIG. 56 illustrates an applied actuation force represented by the arrow 93C acting on a finger pad or actuation region 89C.

Figure 55:
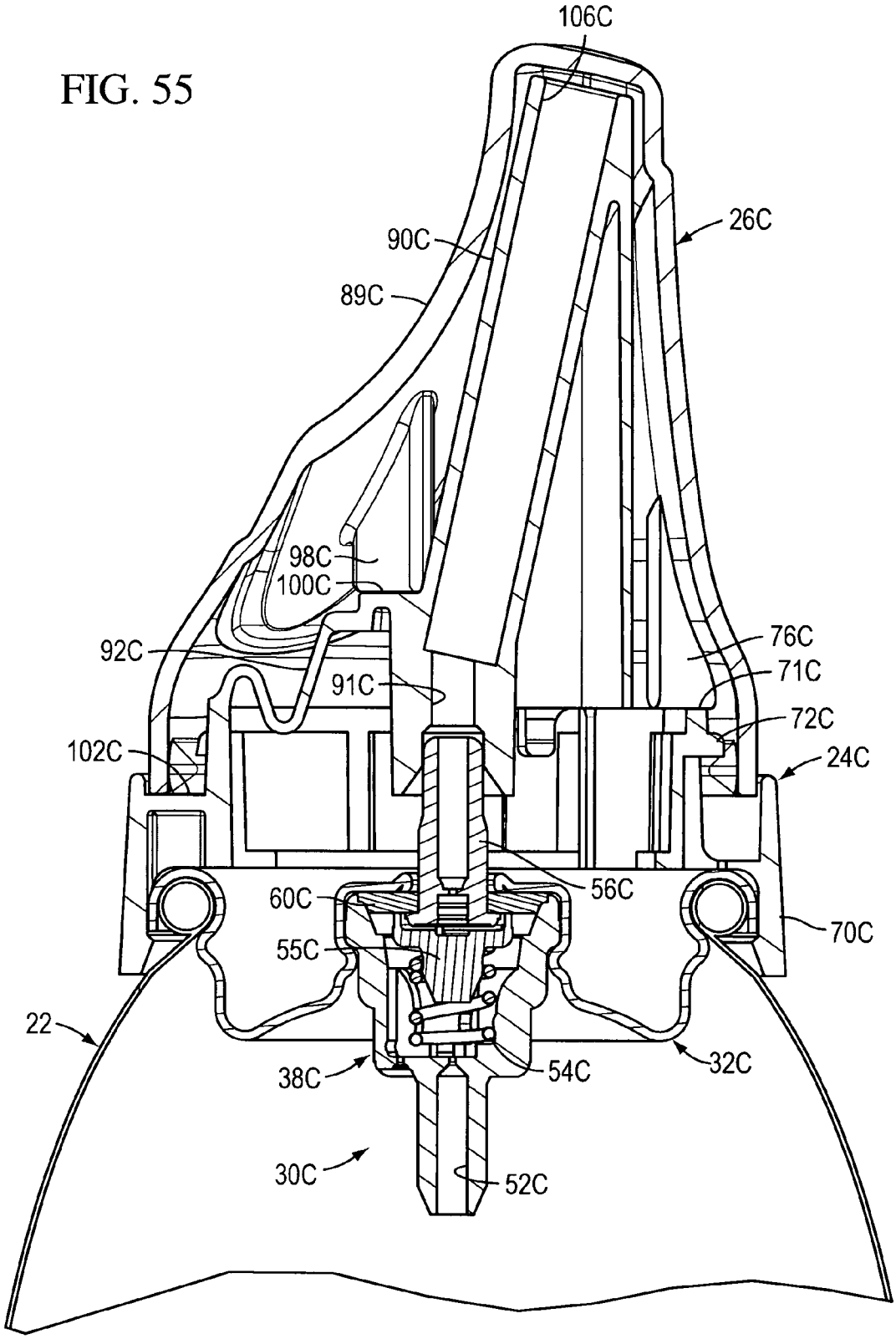
FIG. 55 is a cross-sectional view similar to FIG. 51, but FIG. 55 shows the dispenser in the unactuated, but locked condition wherein the actuator has been rotated (compared to FIG. 51) about 45 degrees relative to the base which remains fixed on the container)

In this embodiment, movement of the actuator 26C with respect to the base 24C is generally downwardly and pivotal, generally in the action of the first-described embodiment of the present invention. To this end, the base 24C includes a support surface 102C (FIGS. 52A and 56) which generally pivotally supports the actuator 26C. As seen in FIG. 55, the mounting ring 71C of the base 24C defines, generally at its upper edge, an abutment surface which cooperates with locking elements 76C to prevent relative downward movement of the actuator 26C with respect to the base 24C when the actuator is in its first, locked position. Gaps 103C (FIG. 52A) defined by the mounting ring 71C, for respectively receiving locking tabs 76C in the second, unlocked, actuatable position of the actuator, accommodate the relatively downward, pivotal movement of the actuator with respect to the base. In this embodiment, pivotal movement of the actuator 26C effects movement of nozzle 90C in unison therewith.

The actuator 26C defines, at the distal portion thereof, a discharge opening 104C (FIGS. 51 and 53) through which product is dispensed. The nozzle 70C of the base 24C defines a discharge orifice 106C (FIGS. 52A and 55), which in the second, unlocked position of the actuator, is aligned with the discharge opening 104C of the actuator. A shield element or member 108C (FIG. 52A), having a generally tubular or hollow configuration, extends along the length of the nozzle 90C, and the top of the member 108C acts to close and cover the discharge opening 104C of the actuator when the actuator is in its first, locked position with respect to the base. In the second, unlocked position of the actuator 26C, the nozzle 90C can move with the actuator as the actuator is manipulated, with the discharge opening 106C of the nozzle remaining in alignment and moving with the discharge opening 104C of the actuator for product dispensing.

From the foregoing, it will be appreciated that the dispenser of the present invention provides a number of highly desirable features which facilitate efficient manufacture, efficient storage and shipment of packages incorporating the present dispenser, and convenient use by consumers. Desirably, the dispenser of the present invention requires no hood or overcap, which can otherwise be dislodged or lost, since the actuator of the present dispenser can be positioned and maintained in a first, locked closed position (non-actuatable position). Additionally, if the optional shield element (e.g., member 108) is incorporated for occluding the actuator discharge opening, then post-foaming from the dispenser assembly is minimized, if not altogether prevented, when the actuator is in its locked position. This optional arrangement can also provide an anti-clog arrangement when the dispenser is locked closed. The dispenser also optionally includes an audible/tactile position indicating arrangement desirably permitting a user to readily discern when the dispenser is either locked closed, or in the unlocked position for use.

By the preferred configuration of the dispenser, a mechanical advantage is desirably created by which users can easily effect actuation of conventional valve assemblies. At the same time, the dispenser is configured such that the manner by which it can be actuated by a user permits enhanced directional dispensing by the user. The dispenser is desirably ergonomically pleasing, in comparison with current technologies, thus further facilitating convenient consumer use.

Although some desirable features of the present invention have been illustrated and described with respect to presently preferred embodiments used with an aerosol dispensing valve, it will be appreciated that some features of some aspects or embodiments of the invention can be employed in other types of dispensing systems.

Further, in the preferred forms of the dispenser of the present invention, the various components of the dispenser may be conveniently made entirely, or at least in part, from thermoplastic materials that are injection molded.

It will be readily apparent from the foregoing detailed description of the invention and from the illustrations thereof that numerous variations and modifications may be effected without departing from the true spirit and scope of the novel concepts or principles of this invention.

What is claimed is:

1. In a dispenser for operating a valve on a container for dispensing a fluent substance product wherein the valve includes an outwardly projecting, movable, product-dispensing stem that is normally biased from an actuated, open dispensing position to a closed position, and wherein said dispenser comprises:

a base for being mounted on the container around said valve; and an actuator rotatably mounted on said base, and that is adapted to be operatively associated with said stem for establishing fluid communication between said stem and the exterior of said actuator for dispensing said product to a target area, said actuator being rotatably moveable on said base between:

(A) a first rotated position, which prevents downward movement of said actuator relative to said base for effecting movement of said stem from said closed position to said dispensing position; and (B) a second rotated position, which permits generally downward movement of said actuator relative to said base for moving said stem from said closed position to said open position, one of said actuator and said base defining an abutment surface, and the other one of said actuator and said base defining a locking element, so that in said first rotated position of said actuator, said locking element engages said abutment surface, and so that in said second rotated position said locking element does not engage said abutment surface, to permit generally downward movement of said actuator relative to said base to move said valve stem to said open dispensing position, said dispenser characterized in that said actuator includes a proximal portion mounted on said base, and a distal portion defining a discharge opening, and said base comprises:

i) an annular mounting ring on which said actuator is rotatably mounted, ii) a nozzle having a stem pocket in fluid communication with said stem, and a product-discharge orifice open to the atmosphere for dispensing product in a generally vertical direction through said opening in said actuator, and a single, straight flow passage extending between said stem pocket and said product-discharge orifice, and iii) a flexible connector element for flexibly connecting said nozzle to said mounting ring, so that said generally downward movement of said actuator relative to said base deflects said nozzle relative to said mounting ring for moving said stem from said closed position to said dispensing position, so that product flows through said nozzle, said flexible connector element defining a pair of side edges, said flexible connector element being generally S-shaped.

2. The dispenser in accordance with claim 1 further in combination with said valve.

3. The dispenser in accordance with claim 2 further in combination with said container.

4. The dispenser in accordance with claim 1, in which said actuator is adapted to be connected to a valve stem of one of a spring-biased tilt style valve and a non-tilting, spring-biased vertical style valve.

5. The dispenser in accordance with claim 1, in which said mounting ring defines said abutment surface, said locking element comprising an internal, downwardly projecting arm provided on said actuator.

6. The dispenser in accordance with claim 1, in which said actuator and said mounting ring respectively include inter-engaging elements for effecting a snap-fit of said actuator on said mounting ring.

7. The dispenser in accordance with claim 1, in which one of said base and said actuator defines at least one locking element, and the other one defines at least one stop surface, so that engagement between said locking element and said stop surface limits rotational movement of said actuator relative to said mounting ring of said base.

8. The dispenser in accordance with claim 1, in which one of said base and said actuator defines a flexible, position-indicating projection, and the other one defines a deflector engageable with said projection attendant to rotation of said actuator relative to said base (24) to provide at least one of an audible indication and a tactile indication of the rotated position of said actuator relative (26) to said base (24).

9. The dispenser in accordance with claim 1, in which said base defines a pivot support surface engageable by the proximal portion of said actuator, so that said actuator is generally downwardly, pivotably moveable relative to said base in said second, rotated position of said actuator, and said nozzle moves in unison with said actuator.

10. The dispenser in accordance with claim 1, in which said base defines a clearance region adjacent said mounting ring into which the proximal portion of said actuator is moveable in the second, rotated position of said actuator relative to said base so that said actuator is generally downwardly, non-pivotably moveable relative to said base in said second, rotated position of said actuator, and said nozzle moves in unison with said actuator.

11. The dispenser in accordance with claim 1, in which said base defines a pair of stop surfaces respectively engageable by a pair of said locking elements of said actuator so that a range of rotational movement of said actuator relative to said base between said first and second rotated positions is limited by engagement of said locking elements of said actuator with said stop surfaces of said base.

12. In a dispenser for operating a valve on a container for dispensing a fluent substance product wherein the valve includes an outwardly projecting, movable, product-dispensing stem that is normally biased from an actuated, open dispensing position to a closed position, and wherein said dispenser comprises:

a base for being mounted on the container around said valve; and an actuator rotatably mounted on said base, and that is adapted to be operatively associated with said stem for establishing fluid communication between said stem and the exterior of said actuator for dispensing said product to a target area, said actuator being rotatably moveable on said base between:

(A) a first rotated position, which prevents downward movement of said actuator relative to said base for effecting movement of said stem from said closed position to said dispensing position; and (B) a second rotated position, which permits generally downward movement of said actuator relative to said base for moving said stem from said closed position to said open position, one of said actuator and said base defining an abutment surface, and the other one of said actuator and said base defining a locking element, so that in said first rotated position of said actuator, said locking element engages said abutment surface, and so that in said second rotated position said locking element does not engage said abutment surface, to permit generally downward movement of said actuator relative to said base to move said valve stem to said open dispensing position, said dispenser characterized in that said actuator includes a proximal portion mounted on said base, and a distal portion defining a discharge opening, and said base comprises:

i) an annular mounting ring on which said actuator is rotatably mounted, ii) a nozzle having a stem pocket in fluid communication with said stem, and a product-discharge orifice open to the atmosphere for dispensing product in a generally vertical direction through said opening in said actuator, and a single, straight flow passage extending between said stem pocket and said product-discharge orifice, and iii) a flexible connector element for flexibly connecting said nozzle to said mounting ring, so that said generally downward movement of said actuator relative to said base deflects said nozzle relative to said mounting ring for moving said stem from said closed position to said dispensing position, so that product flows through said nozzle, said flexible connector element defining a pair of side edges, wherein said nozzle includes a shield element, said shield element being positioned generally inwardly of said discharge opening of said distal portion of said actuator when said actuator is in said first position.

13. The dispenser in accordance with claim 12, wherein said shield element is generally planar and extends generally laterally from said discharge orifice.

14. The dispenser in accordance with claim 12, wherein said shield element is generally tubular.

15. The dispenser in accordance with claim 12, in which said actuator is adapted to be connected to a valve stem of one of a spring-biased tilt style valve and a non-tilting, spring-biased vertical style valve.

16. The dispenser in accordance with claim 12, in which one of said base and said actuator defines at least one locking element, and the other one defines at least one stop surface, so that engagement between said locking element and said stop surface limits rotational movement of said actuator relative to said mounting ring of said base.

17. The dispenser in accordance with claim 12, in which one of said base and said actuator defines a flexible, position-indicating projection, and the other one defines a deflector engageable with said projection attendant to rotation of said actuator relative to said base (24) to provide at least one of an audible indication and a tactile indication of the rotated position of said actuator relative (26) to said base (24).

18. The dispenser in accordance with claim 12, in which said base defines a pivot support surface engageable by the proximal portion of said actuator, so that said actuator is generally downwardly, pivotably moveable relative to said base in said second, rotated position of said actuator, and said nozzle moves in unison with said actuator.

19. The dispenser in accordance with claim 12, wherein said flexible connector element is generally arcuately-shaped.

20. The dispenser in accordance with claim 12, in which said base defines a pair of stop surfaces respectively engageable by a pair of said locking elements of said actuator so that a range of rotational movement of said actuator relative to said base between said first and second rotated positions is limited by engagement of said locking elements of said actuator with said stop surfaces of said base.

* * * * *